US012385715B2

(12) United States Patent
Spicer et al.

(10) Patent No.: US 12,385,715 B2
(45) Date of Patent: Aug. 12, 2025

(54) COMPRESSED GAS PROJECTILE LAUNCHING DEVICES

(71) Applicant: KORE OUTDOOR (US), INC., Fort Wayne, IN (US)

(72) Inventors: Louis Spicer, Sewell, NJ (US); Mark Pearce, Lindenwold, NJ (US); Robert W. Ambrose, Marlton, NJ (US); John Ronald Rice, Stoke-on-Trent (GB)

(73) Assignee: KORE OUTDOOR (US), INC., Fort Wayne, IN (US)

( * ) Notice: Subject to any disclaimer, the term of this patent is extended or adjusted under 35 U.S.C. 154(b) by 0 days.

(21) Appl. No.: 18/029,564

(22) PCT Filed: Sep. 29, 2021

(86) PCT No.: PCT/US2021/052575
§ 371 (c)(1),
(2) Date: Mar. 30, 2023

(87) PCT Pub. No.: WO2022/072443
PCT Pub. Date: Apr. 7, 2022

(65) Prior Publication Data

US 2023/0332861 A1 Oct. 19, 2023

Related U.S. Application Data

(60) Provisional application No. 63/085,750, filed on Sep. 30, 2020.

(51) Int. Cl.
*F41B 11/52* (2013.01)
*F41B 11/62* (2013.01)

(52) U.S. Cl.
CPC ..... *F41B 11/52* (2013.01); *F41B 11/62* (2013.01)

(58) Field of Classification Search
CPC ..... F41B 11/52; F41B 11/53; F41B 11/62
See application file for complete search history.

(56) References Cited

U.S. PATENT DOCUMENTS 452,882 A * 5/1891 Giffard ..... F41B 11/72 251/74
1,332,992 A 3/1920 Moore et al.
(Continued)

FOREIGN PATENT DOCUMENTS

DE 876370 C 5/1953
DE 2035097 A1 1/1972
(Continued)

OTHER PUBLICATIONS

Valken V-Max Manual, Available at: https://paintball.skiep.pl/public/assets/images/instrukcje/Valken%20V-max%20manual.pdf (2011).
(Continued)

*Primary Examiner* — Bret Hayes
(74) *Attorney, Agent, or Firm* — Volpe Koenig

(57) ABSTRACT

Various projectile launching devices are disclosed herein. In one aspect, the projectile launching device includes a gas-powered projectile agitator, an anti-jam assembly, and a compressed gas canister frame positioned below a body of the device. In another embodiment, the projectile launching device includes a rear-loading hopper and a projectile agitator which is actuated by mechanical power via a linkage with a pump handle.

18 Claims, 30 Drawing Sheets

(56) References Cited

U.S. PATENT DOCUMENTS 1,332,993 A 3/1920 Moore et al.
1,403,689 A 1/1922 Hyndman
1,403,719 A 1/1922 Szepe
1,404,689 A 1/1922 Fairweather
1,743,576 A 1/1930 Smith
1,867,513 A 7/1932 Lahti
1,954,093 A 4/1934 Nelson
2,064,888 A 12/1936 Dickinson
2,307,015 A 1/1943 Boynton
2,338,984 A 1/1944 Van et al.
2,357,951 A 9/1944 Hale
2,398,263 A 4/1946 Trimbach
RE23,951 E 3/1949 Graham
2,526,969 A 10/1950 Powers
2,612,888 A * 10/1952 Wells ..... F41A 9/62 124/53
2,639,904 A 5/1953 McMaster et al.
2,641,412 A 6/1953 Byberg
2,676,633 A 4/1954 Lohre et al.
2,716,973 A 9/1955 Desi
3,089,476 A 5/1963 Wolverton
3,119,384 A * 1/1964 Merz ..... F41B 11/62 124/51.1
3,134,301 A 5/1964 Even
3,227,148 A * 1/1966 Spack ..... F41B 11/62 124/76
3,233,125 A 2/1966 Buie
3,248,008 A 4/1966 Meierjohan
3,384,354 A 5/1968 Migule et al.
3,410,453 A 11/1968 Lawrence
3,467,073 A 9/1969 Rhodes
3,610,223 A 10/1971 Green
3,695,246 A 10/1972 Fillippi et al.
3,724,437 A 4/1973 Halstead
3,745,687 A 7/1973 Koon, Jr.
3,766,901 A 10/1973 Cleary et al.
3,777,732 A 12/1973 Holloway et al.
3,788,298 A 1/1974 Hale
3,789,891 A 2/1974 Bosch
3,814,283 A 6/1974 Cioth
3,844,267 A 10/1974 Mohr
3,855,988 A 12/1974 Sweeton
3,867,921 A 2/1975 Politzer
3,930,486 A 1/1976 Kahelin
3,978,841 A 9/1976 Yarur et al.
3,996,916 A 12/1976 Koehn et al.
4,021,036 A 5/1977 Nelson et al.
4,027,646 A 6/1977 Sweeton
4,034,644 A 7/1977 Hupp et al.
4,073,280 A 2/1978 Koehn et al.
4,083,349 A * 4/1978 Clifford ..... F41B 11/52 124/53.5
4,185,824 A 1/1980 Natwick
4,207,857 A 6/1980 Balka, Jr.
4,280,697 A 7/1981 Yuasa
4,299,383 A 11/1981 Yuasa
4,332,097 A 6/1982 Taylor, Jr.
4,481,862 A 11/1984 Wiethoff et al.
4,487,103 A 12/1984 Atchisson
4,563,999 A 1/1986 Miehlich
4,646,709 A 3/1987 Kholin
4,676,137 A 6/1987 Stockton et al.
4,759,435 A 7/1988 Cedrone
4,819,609 A 4/1989 Tippmann
4,834,060 A 5/1989 Greene
4,850,330 A 7/1989 Nagayoshi
4,896,648 A 1/1990 Boller
4,923,066 A 5/1990 Ophir et al.
4,926,742 A 5/1990 Ma et al.
4,930,400 A 6/1990 Brandl et al.
4,936,282 A 6/1990 Dobbins et al.
4,951,548 A 8/1990 Wixon et al.
4,951,644 A 8/1990 Bon
4,956,951 A 9/1990 Kannankeril
4,986,251 A 1/1991 Lilley
4,993,400 A 2/1991 Fitzwater
5,063,905 A 11/1991 Farrell
5,097,816 A 3/1992 Miller
5,097,985 A 3/1992 Jones
5,166,457 A 11/1992 Lorenzetti
5,251,906 A 10/1993 Heller et al.
5,282,454 A 2/1994 Bell et al.
5,335,579 A 8/1994 David
5,353,712 A 10/1994 Olson
5,361,746 A 11/1994 Szente
5,383,442 A 1/1995 Tippmann
5,456,153 A 10/1995 Bentley et al.
5,464,208 A 11/1995 Pierce
5,490,493 A 2/1996 Salansky
5,497,758 A 3/1996 Dobbins et al.
5,502,455 A 3/1996 Ferrin et al.
5,505,188 A 4/1996 Williams
5,507,271 A 4/1996 Actor
5,511,333 A 4/1996 Farrell
5,520,171 A 5/1996 David
5,542,570 A 8/1996 Nottingham et al.
5,555,662 A 9/1996 Teetzel
5,561,258 A 10/1996 Bentley et al.
5,600,083 A 2/1997 Bentley et al.
5,673,679 A 10/1997 Walters
5,675,110 A 10/1997 Gyer et al.
5,722,383 A 3/1998 Tippmann, Sr. et al.
5,727,538 A 3/1998 Ellis
5,736,720 A 4/1998 Bell et al.
5,749,797 A 5/1998 Sunseri et al.
5,755,056 A 5/1998 Danner et al.
5,762,058 A * 6/1998 Cheng ..... F41A 21/32 124/83
5,771,875 A 6/1998 Sullivan
5,784,985 A 7/1998 Lodico et al.
5,791,325 A 8/1998 Anderson
5,794,606 A 8/1998 Deak
5,809,983 A 9/1998 Stoneking
5,816,232 A 10/1998 Bell
5,819,715 A 10/1998 Haneda et al.
5,839,422 A 11/1998 Ferris
5,881,962 A 3/1999 Schmidt et al.
5,887,578 A 3/1999 Bakeris et al.
5,947,100 A 9/1999 Anderson
5,950,611 A 9/1999 Lopez et al.
5,954,042 A 9/1999 Harvey
6,032,395 A 3/2000 Bentley et al.
6,055,975 A 5/2000 Gallagher et al.
6,062,208 A 5/2000 Seefeldt et al.
6,109,252 A 8/2000 Stevens
6,176,230 B1 1/2001 Thompson
6,206,562 B1 3/2001 Eyraud et al.
6,213,110 B1 4/2001 Christopher et al.
6,220,237 B1 4/2001 Johnson et al.
6,305,367 B1 10/2001 Kotsiopoulos et al.
6,311,682 B1 11/2001 Rice et al.
6,325,233 B1 12/2001 Harris
6,327,953 B1 12/2001 Andresen
6,347,621 B1 2/2002 Guthrie
6,374,819 B1 4/2002 Ming-Hsien
6,408,836 B1 6/2002 Ming-Hsien
D459,767 S 7/2002 Rushton
6,415,781 B1 7/2002 Perrone
6,418,919 B1 7/2002 Perrone
6,425,781 B1 7/2002 Bernstein et al.
6,460,530 B1 10/2002 Backeris et al.
6,467,473 B1 10/2002 Kostiopoulos
6,468,879 B1 10/2002 Lamure et al.
6,481,432 B2 11/2002 Rushton et al.
6,488,019 B2 12/2002 Kotsiopoulos
6,502,567 B1 1/2003 Christopher et al.
6,526,955 B1 3/2003 Juan
6,588,412 B2 7/2003 Ferrara et al.
6,591,824 B2 7/2003 Hatcher
6,609,511 B2 8/2003 Kotsiopoulos et al.
6,615,814 B1 9/2003 Rice et al.
6,644,293 B2 11/2003 Jong
6,666,203 B2 12/2003 Maeda et al.
6,684,873 B1 2/2004 Anderson et al.

(56) References Cited

U.S. PATENT DOCUMENTS

| | | | |
|---|---|---|---|
| 6,701,907 | B2 | 3/2004 | Christopher et al. |
| 6,708,685 | B2 | 3/2004 | Masse |
| 6,722,355 | B1 | 4/2004 | Andrews, Jr. |
| 6,725,852 | B1 | 4/2004 | Yokota et al. |
| 6,729,321 | B2 | 5/2004 | Ho |
| 6,729,497 | B2 | 5/2004 | Rice et al. |
| 6,739,322 | B2 | 5/2004 | Rice et al. |
| 6,739,323 | B2 | 5/2004 | Tippmann, Jr. |
| 6,742,512 | B1 | 6/2004 | Ho et al. |
| 6,752,137 | B2 | 6/2004 | Brunette et al. |
| 6,792,933 | B2 | 9/2004 | Christopher et al. |
| 6,802,306 | B1 | 10/2004 | Rice |
| 6,860,285 | B2 | 3/2005 | Ehrman et al. |
| 6,889,680 | B2 | 5/2005 | Christopher et al. |
| 6,915,792 | B1 | 7/2005 | Sheng |
| 6,978,776 | B2 | 12/2005 | Hamilton |
| 6,981,493 | B1 | 1/2006 | Poteracke |
| 7,000,603 | B1 | 2/2006 | Steenbeke |
| 7,017,569 | B2 | 3/2006 | Jong |
| 7,021,302 | B2 | 4/2006 | Neumaster et al. |
| 7,040,505 | B2 | 5/2006 | Hashimoto et al. |
| 7,077,118 | B2 | 7/2006 | Lewis |
| 7,107,981 | B1 | 9/2006 | Dunn |
| D535,339 | S | 1/2007 | Broersma |
| 7,159,585 | B2 | 1/2007 | Quinn et al. |
| 7,216,641 | B2 | 5/2007 | Friesen et al. |
| 7,222,617 | B2 | 5/2007 | Andresen |
| D544,047 | S | 6/2007 | Bell et al. |
| 7,234,456 | B2 | 6/2007 | Andresen |
| 7,270,120 | B2 | 9/2007 | Broersma et al. |
| 7,270,121 | B2 | 9/2007 | Lubben |
| 7,322,347 | B2 | 1/2008 | Broersma |
| 7,322,348 | B2 | 1/2008 | Chen |
| 7,343,909 | B2 | 3/2008 | Christopher et al. |
| D567,302 | S | 4/2008 | Choi |
| D567,303 | S | 4/2008 | Neumaster |
| 7,357,129 | B2 | 4/2008 | Neumaster et al. |
| 7,357,130 | B2 | 4/2008 | Broersma |
| D572,318 | S | 7/2008 | Broersma |
| 7,428,899 | B2 | 9/2008 | Andresen |
| 7,445,002 | B2 | 11/2008 | Christopher et al. |
| D584,776 | S | 1/2009 | Stevens |
| 7,617,814 | B2 | 11/2009 | Leppert |
| 7,617,817 | B1 | 11/2009 | Kulp |
| 7,975,683 | B1 | 7/2011 | Williams et al. |
| 8,047,191 | B2 | 11/2011 | Christopher et al. |
| 8,118,016 | B2 | 2/2012 | Italia et al. |
| 8,235,030 | B2 | 8/2012 | Kaakkola et al. |
| 8,381,710 | B2 | 2/2013 | Nguyen |
| 8,387,607 | B2 | 3/2013 | Christopher et al. |
| 8,408,837 | B2 | 4/2013 | Helfer et al. |
| 8,415,781 | B2 | 4/2013 | Kariya et al. |
| 8,430,086 | B2 | 4/2013 | Tippmann, Jr. et al. |
| 8,726,895 | B2 | 5/2014 | Tippmann, Jr. et al. |
| 8,746,225 | B2 | 6/2014 | Christopher et al. |
| 8,857,658 | B2 | 10/2014 | Lin |
| 8,985,378 | B2 | 3/2015 | Wan et al. |
| RE45,490 | E | 4/2015 | Italia et al. |
| 9,500,435 | B2 | 11/2016 | Tseng |
| 9,733,042 | B2 | 8/2017 | Yuen et al. |
| 9,857,140 | B2 | 1/2018 | Italia |
| 9,857,141 | B2 | 1/2018 | Spurlock |
| 10,520,520 | B2 | 12/2019 | Kaeppeli et al. |
| 11,796,280 | B2 | 10/2023 | Pearce |
| 2002/0014230 | A1 | 2/2002 | Christopher et al. |
| 2002/0020402 | A1 | 2/2002 | Kotsiopoulos |
| 2002/0059927 | A1 | 5/2002 | Woods, Sr. |
| 2002/0117159 | A1 | 8/2002 | Kotsiopoulos et al. |
| 2003/0017173 | A1 | 1/2003 | Markham et al. |
| 2003/0079731 | A1 | 5/2003 | Dobbins |
| 2003/0127084 | A1 | 7/2003 | Tippmann, Jr. |
| 2003/0127085 | A1 | 7/2003 | Brunette |
| 2004/0074487 | A1 | 4/2004 | Christopher et al. |
| 2004/0074489 | A1 | 4/2004 | Neumaster et al. |
| 2004/0112356 | A1 | 6/2004 | Hatcher |
| 2004/0134475 | A1 | 7/2004 | Jong |
| 2004/0194772 | A1 | 10/2004 | Hamilton |
| 2004/0211402 | A1 | 10/2004 | Christopher et al. |
| 2004/0245276 | A1 | 12/2004 | Hashimoto et al. |
| 2005/0028801 | A1 | 2/2005 | Lewis |
| 2005/0121015 | A1 | 6/2005 | Postorivo, Jr. |
| 2005/0188974 | A1 | 9/2005 | Pedicini et al. |
| 2005/0217653 | A1 | 10/2005 | Christopher et al. |
| 2005/0241628 | A1 | 11/2005 | Hatcher |
| 2005/0274370 | A1 | 12/2005 | Lubben |
| 2005/0274371 | A1 | 12/2005 | Lubben |
| 2005/0284456 | A1 | 12/2005 | Chipley |
| 2005/0284457 | A1 | 12/2005 | Hatcher |
| 2006/0005823 | A1 | 1/2006 | Quinn et al. |
| 2006/0032488 | A1 | 2/2006 | Telford |
| 2006/0037597 | A1 | 2/2006 | Wood |
| 2006/0054151 | A1 | 3/2006 | Christopher et al. |
| 2006/0086347 | A1 | 4/2006 | Hedberg |
| 2006/0124118 | A1 | 6/2006 | Dobbins |
| 2006/0130821 | A1 | 6/2006 | Hamilton |
| 2006/0157041 | A1 | 7/2006 | Friesen |
| 2006/0196489 | A1 | 9/2006 | Campo |
| 2006/0249131 | A1 | 11/2006 | Broersma |
| 2006/0254572 | A1 | 11/2006 | Hall |
| 2007/0012303 | A1 | 1/2007 | Christopher et al. |
| 2007/0012304 | A1 | 1/2007 | van Dorsser et al. |
| 2007/0017494 | A1 | 1/2007 | Andresen |
| 2007/0017495 | A1 | 1/2007 | Andresen |
| 2007/0028908 | A1* | 2/2007 | Deak ..... F41B 11/52 124/73 |
| 2007/0056573 | A1 | 3/2007 | Campo |
| 2007/0062506 | A1 | 3/2007 | Bell |
| 2007/0081233 | A1 | 4/2007 | Hattori |
| 2007/0101981 | A1 | 5/2007 | Chen |
| 2007/0113834 | A1 | 5/2007 | Spicer |
| 2007/0137631 | A1 | 6/2007 | Christopher |
| 2007/0175463 | A1 | 8/2007 | Higgins et al. |
| 2007/0181117 | A1 | 8/2007 | Tippmann, Jr. et al. |
| 2007/0246479 | A1 | 10/2007 | Andresen |
| 2007/0256676 | A1 | 11/2007 | Orvis et al. |
| 2008/0017178 | A1 | 1/2008 | Marques et al. |
| 2008/0047535 | A1 | 2/2008 | Handel |
| 2008/0047536 | A1 | 2/2008 | Chen |
| 2008/0047537 | A1 | 2/2008 | Kulp et al. |
| 2008/0087264 | A1 | 4/2008 | Postorivo |
| 2009/0000608 | A1 | 1/2009 | Christopher et al. |
| 2009/0025700 | A1 | 1/2009 | Andresen |
| 2009/0120420 | A1* | 5/2009 | Tippmann, Jr. ..... F41A 35/00 206/234 |
| 2009/0133680 | A1 | 5/2009 | Christopher et al. |
| 2011/0011386 | A1* | 1/2011 | Tran ..... F41B 11/57 124/51.1 |
| 2011/0073092 | A1 | 3/2011 | Yeh |
| 2012/0103316 | A1 | 5/2012 | Kaakkola et al. |
| 2013/0015098 | A1 | 1/2013 | Chen |
| 2013/0167821 | A1 | 7/2013 | Nguyen |
| 2013/0220293 | A1 | 9/2013 | Kaakkola |
| 2018/0066913 | A1 | 3/2018 | Stevens |
| 2019/0323794 | A1 | 10/2019 | Wood |
| 2021/0381797 | A1 | 12/2021 | Buys |

FOREIGN PATENT DOCUMENTS

| | | | |
|---|---|---|---|
| DE | 3721527 | A1 | 6/1990 |
| DE | 4343870 | A1 | 6/1994 |
| DE | 19922589 | A1 | 12/2001 |
| EP | 0075970 | A1 | 4/1983 |
| EP | 1054228 | A2 | 11/2000 |
| EP | 01653189 | A1 | 5/2006 |
| FR | 921527 | A | 5/1947 |
| FR | 1216612 | A | 4/1960 |
| GB | 470201 | A | 8/1937 |
| GB | 551077 | A | 2/1943 |
| GB | 2322438 | A | 8/1998 |
| WO | 9813660 | A1 | 4/1998 |
| WO | 0144745 | A1 | 6/2001 |
| WO | 0242708 | A1 | 5/2002 |
| WO | 03087698 | A1 | 10/2003 |
| WO | 2007033309 | A2 | 3/2007 |

(56) References Cited

FOREIGN PATENT DOCUMENTS

| | | | |
|---|---|---|---|
| WO | 2007035601 | A2 | 3/2007 |
| WO | 2007044546 | A2 | 4/2007 |
| WO | 2007044822 | A2 | 4/2007 |
| WO | 2008104061 | A1 | 9/2008 |

OTHER PUBLICATIONS

Valken V-Max Plus Paintball Loader Owners Manual (2014).
Virtue Spire III Paintball Loader Manual, Available at: https://www.manualslib.com/manual/1709739/Virtue-Spire-III.html (2012).
Virtue Spire Paintball Loader Manual, Available at: https://pbmanuals.com/downloads/775_Virtue_Virtue_Spire_Hopper_Manual_ENG.pdf (2013).

* cited by examiner

COMPRESSED GAS PROJECTILE LAUNCHING DEVICES

INCORPORATION BY REFERENCE

This application is a § 371 application of International Application No. PCT/US2021/052575, filed Sep. 29, 2021, which claims the benefit of U.S. Provisional Application No. 63/085,750, filed on Sep. 30, 2020, which is incorporated herein by reference as if fully set forth.

FIELD OF INVENTION

The present disclosure relates to the field of projectile launchers.

BACKGROUND

Various types of projectile launching devices are well known. Such projectile launching devices are shown and described, for example, in U.S. Pat. Nos. 10,704,859, 7,975,683, 9,658,027, and 8,950,387, the entire contents of all of which are incorporated by reference herein. Projectile launching devices can be configured to shoot paintballs, foam balls, pellets, or other types of projectiles. The energy required to fire projectiles in these devices can be supplied in a variety of ways. For example, some projectile launching devices rely on compressed gas to fire the projectiles. Other devices require manual pumping of a handle or mechanism to build up air pressure and load a firing spring.

One persistent issue with these devices includes jamming of projectiles in the hopper. This can result in the device malfunctioning or misfiring. Another common issue for these devices involves the safety of the user and any bystanders, particularly during loading and reloading of the projectiles.

It would be desirable to provide a projectile launching device that reliably fires, does not jam, and also includes safety features. It would further be desirable to provide a projectile launching device that is easy to load with projectiles. It would further be desirable to provide a projectile launching device that accommodates soft projectiles and does not cause such projectiles to jam on firing.

SUMMARY

A projectile launching device is disclosed herein. The projectile launching device includes a body, a grip assembly, and a hopper.

In one aspect, the body includes a projectile agitator assembly configured to selectively protrude into the hopper. The projectile agitator assembly can be gas actuated.

In one aspect, the body includes an anti-jam assembly. The anti-jam assembly can include a linkage and an anti-jam spring configured to allow the linkage to move rearward if a bolt of the device engages a jammed projectile.

In one aspect, the grip assembly includes a handle and trigger assembly arranged below a rear portion of the body, and a frame arranged below a front portion of the body. The frame is dimensioned to hold a compressed gas canister. Specifically, the frame includes an opening dimensioned to receive the compressed gas canister. In one aspect, the opening has a longitudinal axis (X1) extending parallel to a longitudinal axis (X2) of the body. The opening of the frame can be positioned below the hopper. The frame can be positioned below the trigger assembly. The frame can be positioned longitudinally inward from a projectile launching opening defined on the body. Preferably, an opening of the frame is circular and configured to be shaped so as to snugly hold a compressed gas canister of appropriate size.

In one aspect, the hopper includes a housing defining a container for projectiles, a lid attached to the housing, and a fill volume limiting wall arranged within the housing.

In one aspect, luminescent projectiles are also provided that are configured to be fired or launched by the projectile launching device.

In another embodiment, a grip for a compressed gas projectile launcher is provided. The grip includes a handle including a trigger assembly, and a frame attached to the handle. The frame defines a sleeve dimensioned to receive a compressed gas canister.

Another projectile launching device is disclosed that includes a body, a grip assembly, and a hopper. A lid is attached to a rear surface of the hopper. This device also includes a projectile agitator configured to: (i) extend at least partially inside of the hopper, and (ii) move relative to an interior chamber defined by the hopper.

Additional embodiments are disclosed herein.

BRIEF DESCRIPTION OF THE DRAWINGS

The foregoing Summary and the following Detailed Description will be better understood when read in conjunction with the appended drawings, which illustrate a preferred embodiment of the disclosure. In the drawings.

DETAILED DESCRIPTION OF THE PREFERRED EMBODIMENTS

Figure 1A:
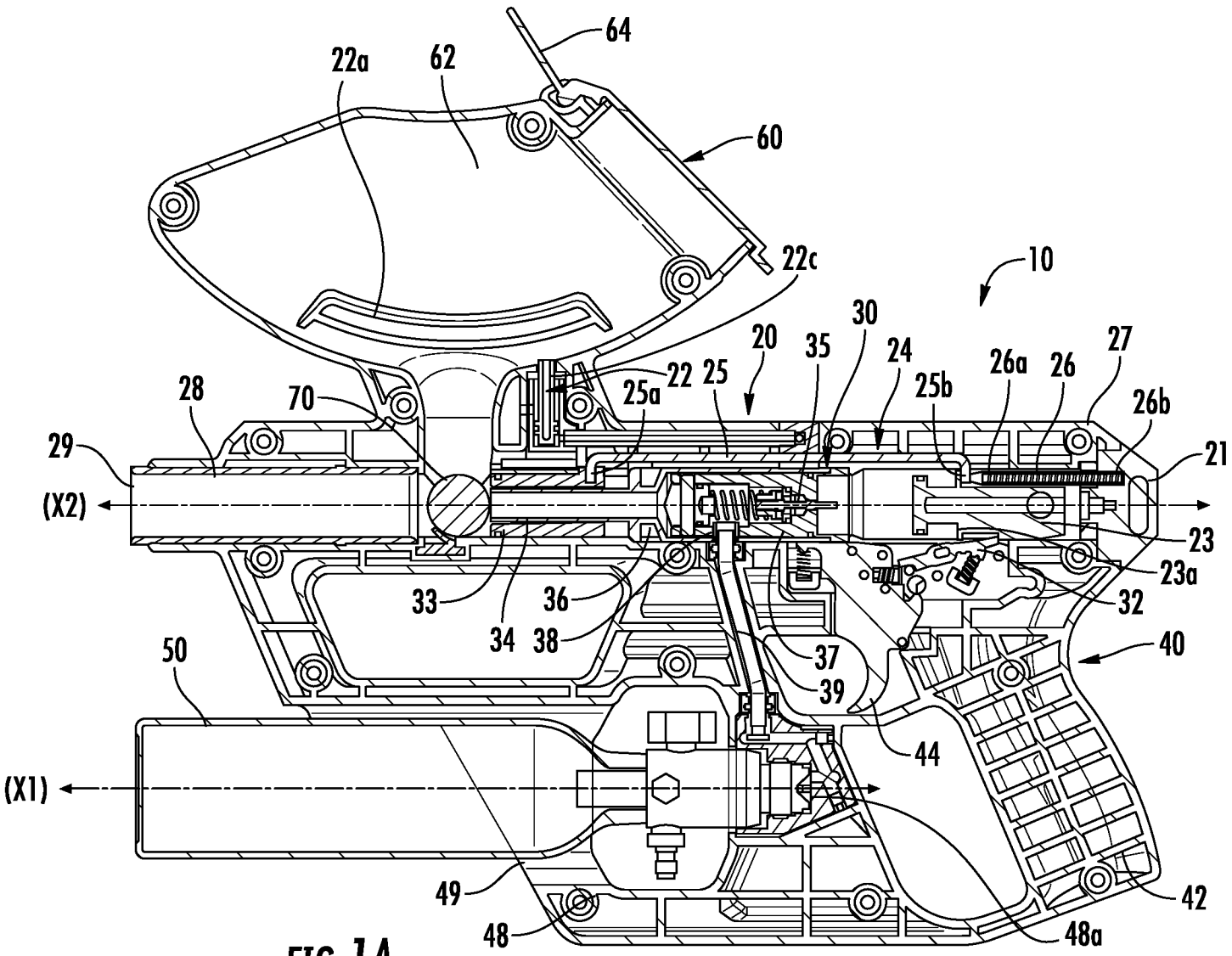
FIG. 1A is a side cross-sectional view of a projectile launching device in a non-firing state or ready-to-fire or rearward state.

Certain terminology is used in the following description for convenience only and is not limiting. "Axially" refers to a direction along an axis (X) of an assembly. "Radially" refers to a direction inward and outward from the axis (X) of the assembly. "Circumferentially" refers to a direction extending along a curve or circumference of a respective element relative to the axis (X) of the assembly. The words "right," "left," "top," and "bottom" designate directions in the drawings to which reference is made. The words "a" and "one," as used in the claims and in the corresponding portions of the specification, are defined as including one or more of the referenced item unless specifically stated otherwise. This terminology includes the words above specifically mentioned, derivatives thereof, and words of similar import. The phrase "at least one" followed by a list of two or more items, such as "A, B, or C," means any individual one of A, B or C as well as any combination thereof.

A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 1B:
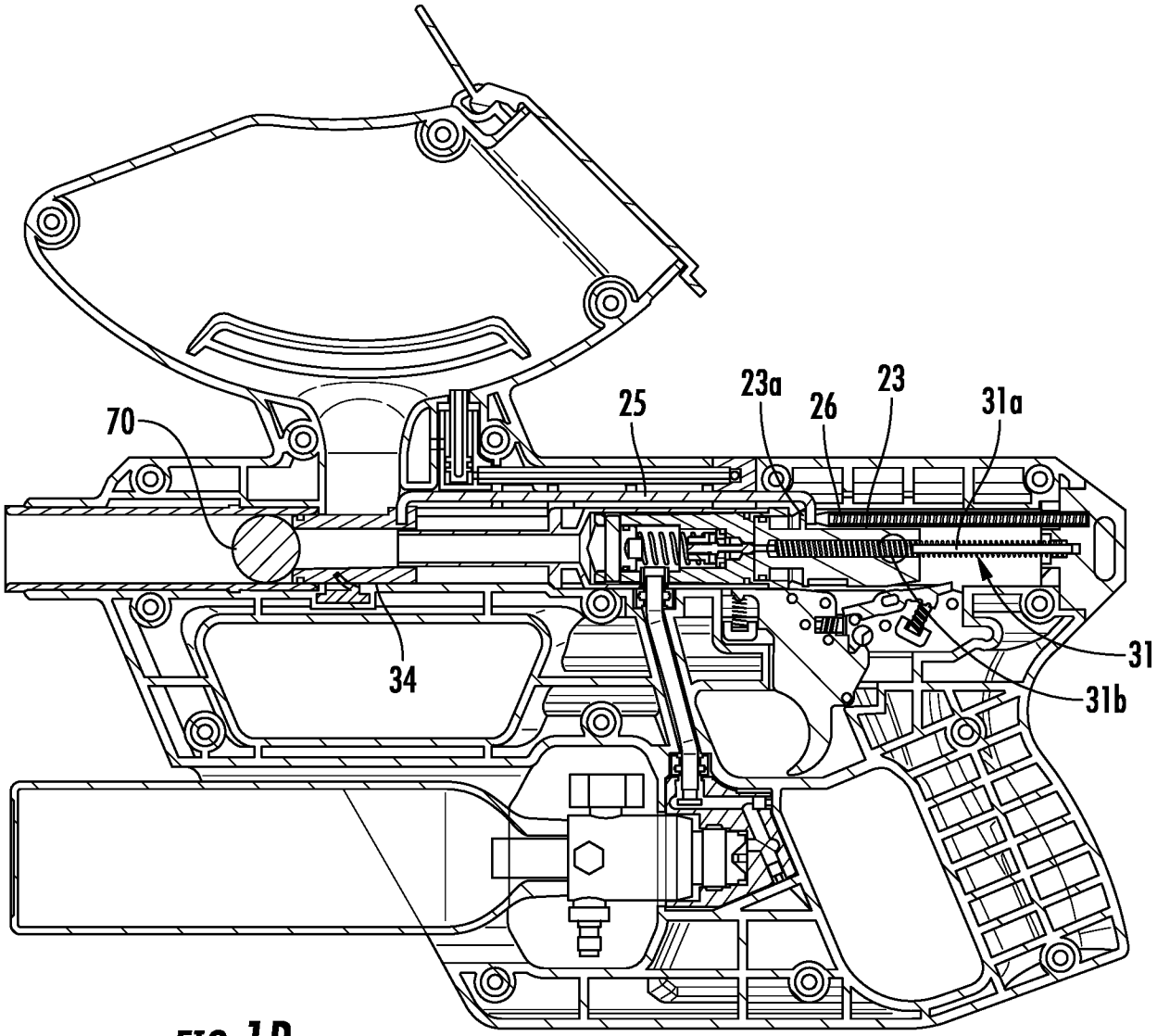
FIG. 1B is a side cross-sectional view of the device of FIG. 1A in a firing state or forward state.

Referring to FIGS. 1A and 1B, an exemplary projectile launching device 10 is illustrated, which includes a body 20, a grip assembly 40, and a hopper 60. The body 20 includes front portion 28 defining projectile launching opening 29 (which may be referred to or comprise a barrel or barrel assembly) and a rear portion 27. The grip assembly 40 includes a handle 42 and trigger assembly 44 arranged below a rear portion 27 of the body 20, and a frame 48 arranged below a front portion 28 of the body 20. The frame 48 is dimensioned to hold a compressed gas canister 50. The hopper 60 includes a housing 62 defining a receptacle or container for projectiles, and a lid 64 attached to the housing 62.

The body 20 includes a generally cylindrical interior passage or space (which may also be known as a breech area or comprise a breech area) for housing at least some of the firing components (such as the hammer and valve components) of the device 10.

A hammer 23 (also known as a ram, striker, or bolt) is disposed within the body 20 adjacent the rear portion 27. The hammer 23 has a forward end facing a valve assembly 30 and the forward end of the hammer 23 is configured to contact a valve pin of the valve assembly 30. As shown in FIGS. 1A and 1B, the hammer 23 can include a seat 23*a*. In one aspect, the seat 23*a* is defined as a radially extending flange or shoulder. The hammer 23 is retained in a cocked or ready position by a sear 32 that pivots to engage a portion of the hammer 23. Actuation of the trigger assembly 44 (such as by pulling the trigger) disengages the sear 32 from the hammer 23, allowing the hammer 23 to drive forward.

As shown in FIG. 1B, a firing assembly 31 including a central post or guide 31*a* and a firing spring 31*b* is provided to drive the hammer 23 forward when the trigger assembly 44 is actuated. In one aspect, the central post 31*a* is dimensioned to extend within central openings or channel of the hammer 23 and firing spring 31*b* to align the hammer 23 and the firing spring 31*b*.

A bolt 33 is disposed within the body 20. A firing tube 34 is partially disposed within the bolt 33, such that the bolt 33 coaxially surrounds the firing tube 34. Forward movement of the bolt 33 causes forward movement and loading of a projectile 70.

The valve assembly 30 is disposed within the body 20 between the hammer 23 and the bolt 33. The valve assembly 30 includes a valve pin 35 extending rearward toward the hammer 23. The valve pin 35 includes a contact end configured to engage with the hammer 23.

The body 20 can include an anti-jam assembly 24. In one aspect, the anti-jam assembly 24 generally includes a linkage 25 and an anti-jam spring 26, which are described in more detail herein.

The anti-jam spring 26 is disposed within the body 20. The anti-jam spring 26 can be positioned between a rear end cap 21 of the body 20 and a region of the hammer 23. In one aspect, a first end 26*a* of the anti-jam spring 26 engages in a region of the hammer 23, and a second end 26*b* of the anti-jam spring 26 engages against the rear end cap 21. It is appreciated that the anti-jam spring 26 can contact or press against any extension in the interior of the body to stop its rearward movement.

As shown in FIG. 1A, the linkage or connecting rod 25 connects the hammer 23 (at a first end 25*a* of the linkage 25) and the bolt 33 (at a second end 25*b* of the linkage 25) for synchronized movement of the hammer 23 and the bolt 33. In one aspect, the second end 25*b* of the linkage 25 is curved and engages against the seat 23*a* of the hammer 23. The first end 25*a* of the linkage 25 can similarly be curved but the first end 25*a* engages with the bolt 33.

The anti-jam spring 26 can engage directly against the second end 25*b* of the linkage 25, or can be engaged against the hammer 23, either directly or indirectly. In one aspect, the anti-jam spring 26 generally provides a biasing force (either directly or indirectly) against the seat 23*a* of the hammer 23. The anti-jam spring 26 is generally configured to provide a damping force, shock absorption, or cushion that prevents the bolt 33 (via the linkage 25 connected to the hammer 23) from inadvertently crushing or overly compressing a stationary, jammed or misaligned projectile 70. In one aspect, the anti-jam spring 26 and the linkage 25 can be secured against the hammer 23 without the need for any additional attachment or fastening means other than the biasing force provided by the anti-jam spring 26 against the linkage 25, which engages against the seat 23*a* of the hammer 23. If the bolt 33 presses against a projectile, the linkage 25 can move rearward and compress the anti-jam spring 26. The linkage 25 will move rearwardly away from the hammer, and therefore, cease to provide, or provide less of, a forward force on the hammer, thus lessening the pressure or force on a projectile.

The valve assembly 30 includes a valve housing 36 and a valve body 37 disposed within the valve housing 36. The valve body 37 includes an inlet port 38 for receiving gas under pressure from a gas line 39. The valve body 37 also includes an outlet port for communicating gas under pressure from within the valve body 37 when the valve assembly 30 is actuated or open. A valve poppet or valve stem, including a sealing member such as a cup seal, is also disposed within the valve body 37.

In one aspect, the body 20 includes a projectile agitator assembly 22 configured to selectively protrude into the hopper 60. In one aspect, the projectile agitator assembly 22 is gas actuated, and may act as a gas-actuated piston. In one aspect, pressurized gas is supplied by the canister 50 to the projectile agitator assembly 22, such that a post or piston 22*c* is driven vertically upward into an interior of the hopper 60. The device 10 can include a poppet or other valve components in order to drive a post or piston into the interior of the hopper 60. In one aspect, the projectile agitator assembly 22, and more specifically the post or piston 22*c*, is configured to engage with a secondary element 22*a*, such as an agitating surface, floor panel, or other type of engagement element that is connected to an interior surface of the hopper and configured to selectively project inwards.

In one aspect, the supply of compressed gas to operate the projectile agitator assembly 22, such as the piston 22*c*, may be supplied from different ports, and may be supplied directly from a valve, an exhaust port, or upstream or downstream (following the flow of compressed gas from a rearward portion of the body to a forward portion of the body) from a valve (i.e. the valve assembly 30). In one aspect, the gas supplied to the projectile agitator assembly 22 is fed as exhaust or firing gas relative to the gas supplied for firing the projectiles. In a preferred embodiment, upon actuation of the valve, such as by the hammer hitting the valve stem, the released firing gas is channeled through a channel, passage or port to actuate the agitator assembly 22. In this manner, the gas used to actuate the agitator assembly 22 may be considered upstream from the bolt 33 and firing tube 34. One or more passages or channels can be supplied or positioned adjacent the valve assembly 30, such that, upon actuation of the valve assembly 30, gas used to actuate the agitator assembly 22 is channeled through a passage upstream of the bolt 33 and firing tube 34. It is appreciated that those of skill in the art can adjust the placement or location of the passages used to feed gas to the agitator assembly 22.

Figure 11A:
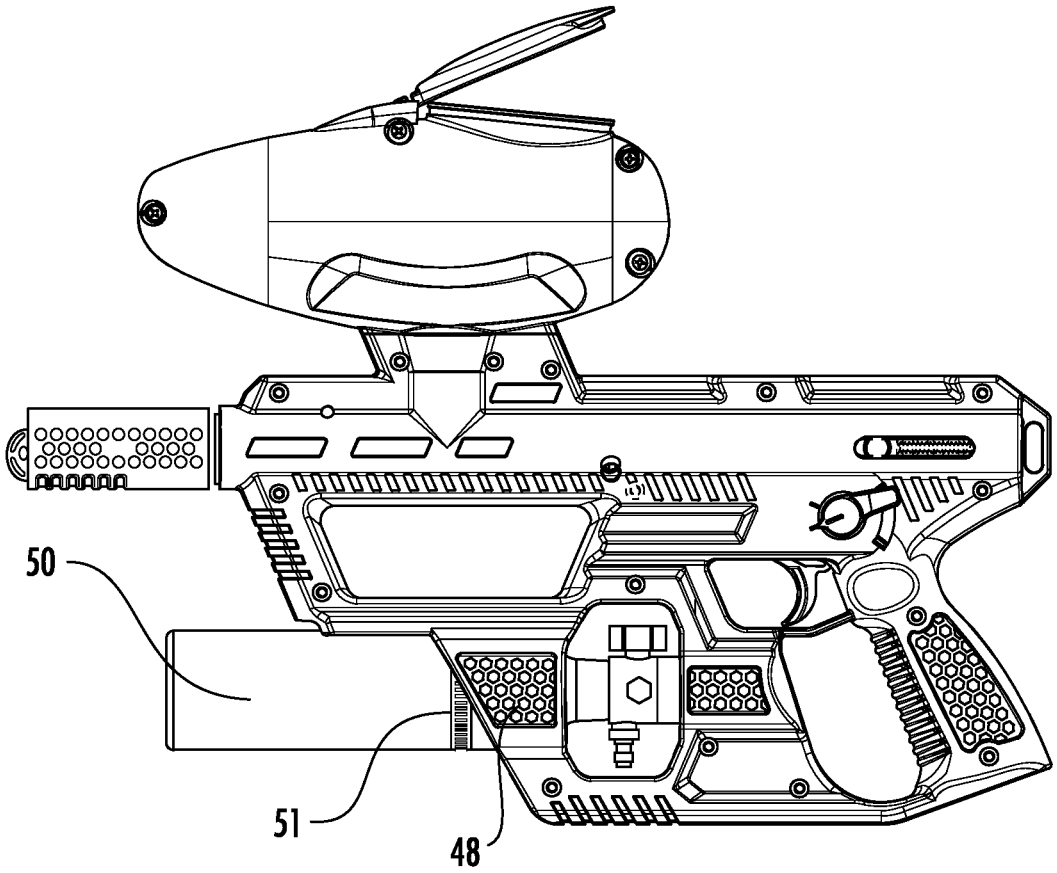
FIG. 11A is a side view of a projectile launching device including a cannister or tank locking feature.
Figure 11B:
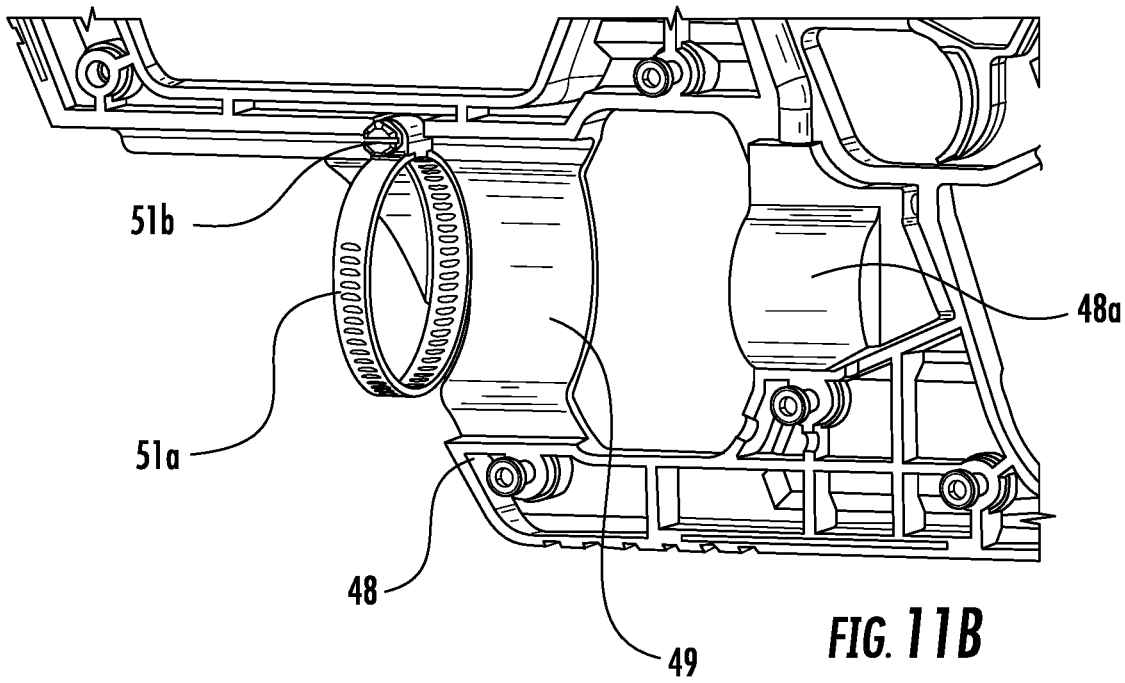
FIG. 11B is a magnified view of the cannister or tank locking feature of FIG. 11A.

In one aspect, the grip assembly 40 includes a handle 42 and trigger assembly 44 arranged below a rear portion 27 of the body 20, and a frame 48 arranged below a front portion 28 of the body 20. The frame 48 includes an opening 49 dimensioned to receive and hold a compressed gas canister 50. The frame 48 can include secondary features, such as a locking assembly as shown in FIGS. 11A and 11B. The compressed gas canister 50 generally includes threading around a neck portion of the compressed gas canister 50 that is configured to matingly engage with threading on a tank interface 48*a* of the frame 48. The connection between the tank interface 48*a* and the compressed gas canister 50 can generally include screwing the compressed gas canister 50 relative to a threaded opening defined by the tank interface 48*a*, as is known in the art.

In one aspect, the opening 49 has a longitudinal axis (X1) extending parallel to a longitudinal axis (X2) of the body 20. The opening 49 of the frame 48 can be positioned below the hopper 60. The frame 48 is positioned below the trigger assembly 44. In one aspect, the frame 48 is positioned longitudinally inward from a projectile launching opening 29 defined on the body 20. The frame 48 preferably includes a circular or oblong opening 49 sized and shaped to receive the outer wall of a compressed gas canister 50 of appropriate size. The compressed gas canister 50 slides into the opening 49 to be position as in, for example, FIG. 1A. Preferably, a front portion of the compressed gas canister 50 does not extend farther than a front of the device, or may be generally aligned with the projectile launching opening 29. In this manner, the arrangement allows for the positioning of a compressed gas canister that is out of the way and does not obstruct a user while using the device.

Figure 2A:
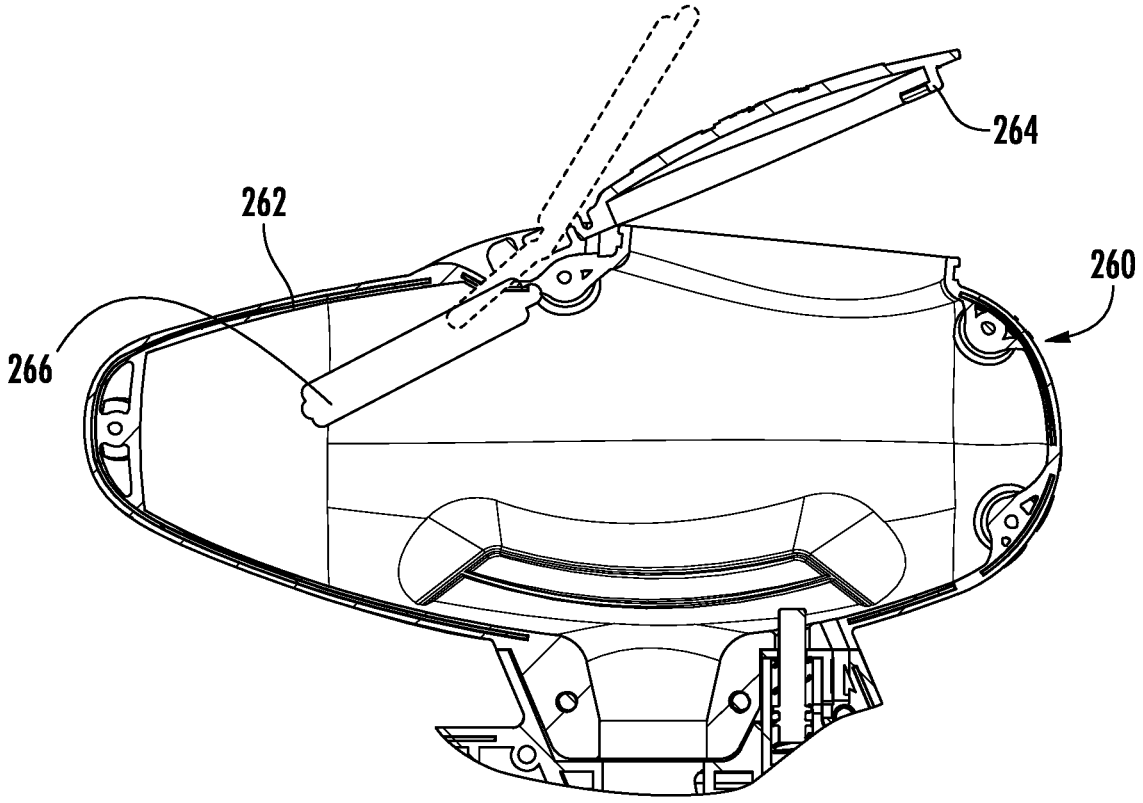
FIG. 2A is a side view of a hopper for the device of FIGS. 1A and 1B with a lid in an opening state.
Figure 2B:
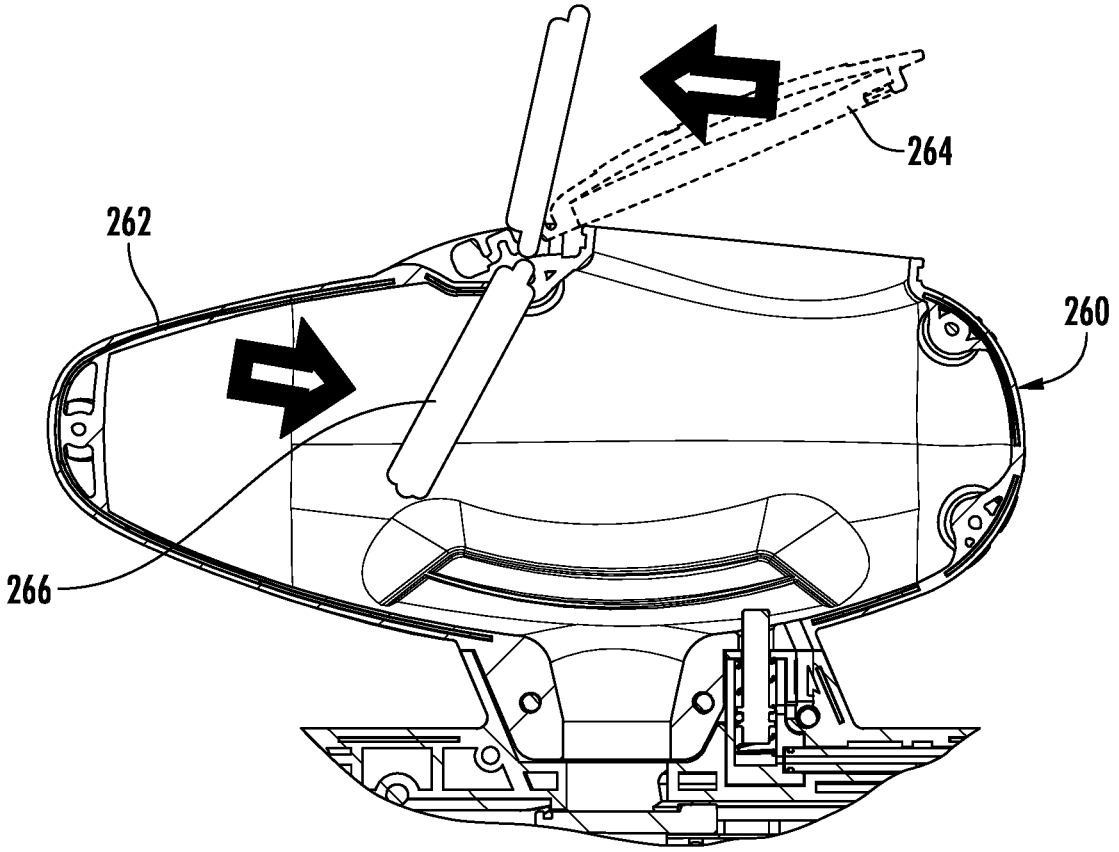
FIG. 2B is a side view of the hopper for the device of FIGS. 1A and 1B with a lid in an open state.
Figure 3A:
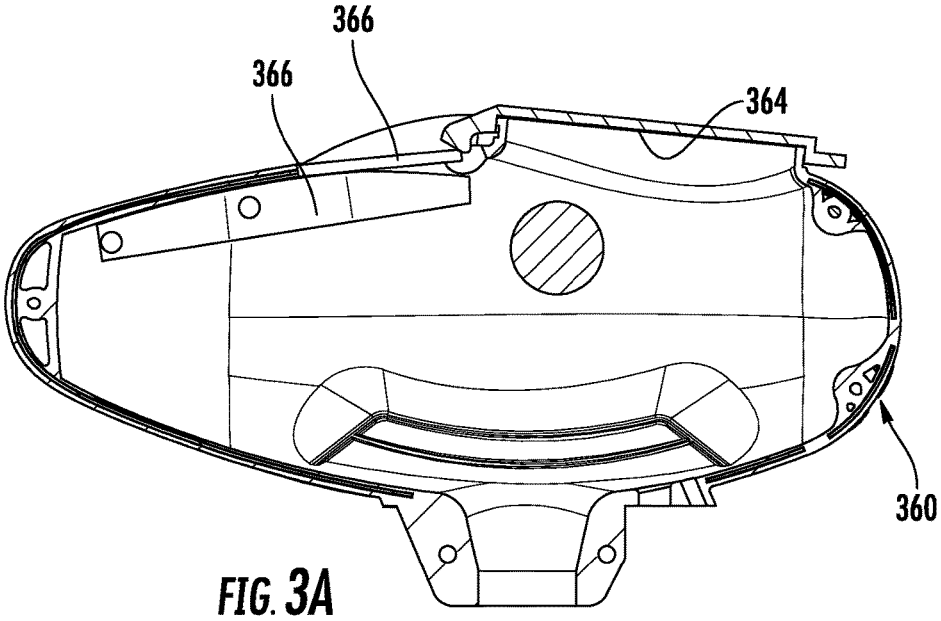
FIG. 3A is a side view of the hopper with the lid in a closed position.
Figure 3B:
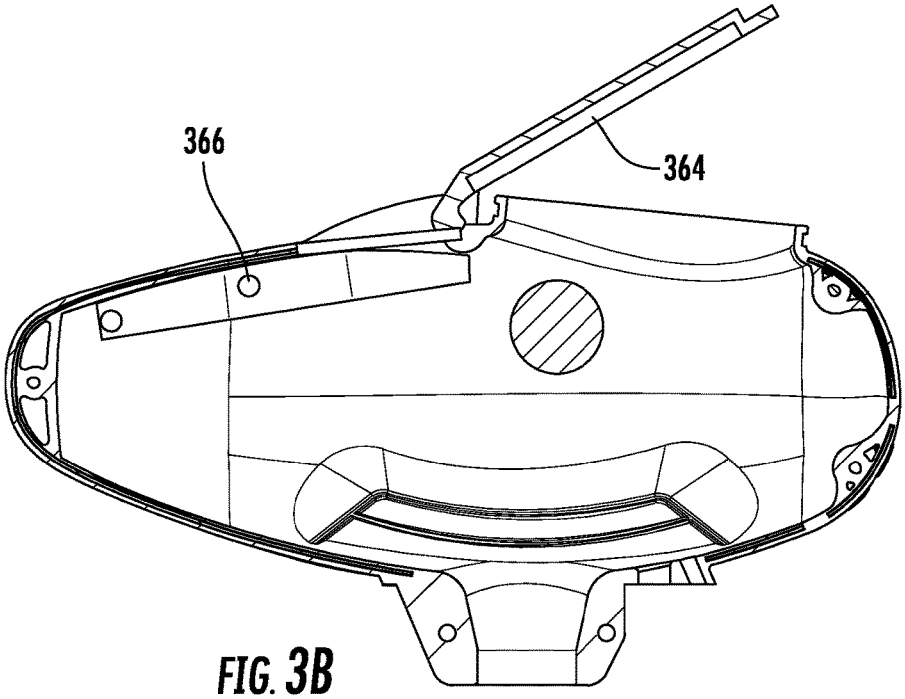
FIG. 3B is a side view of the hopper with the lid in a partially open position.
Figure 3C:
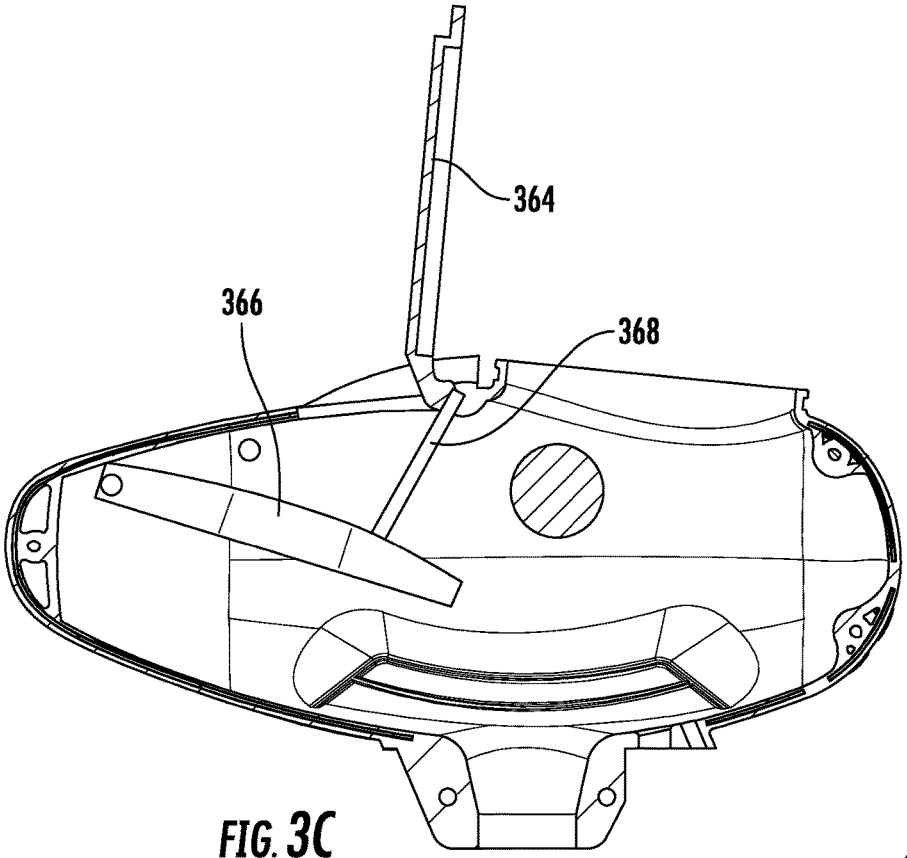
FIG. 3C is a side view of the hopper with the lid in a fully open position.
Figure 3D:
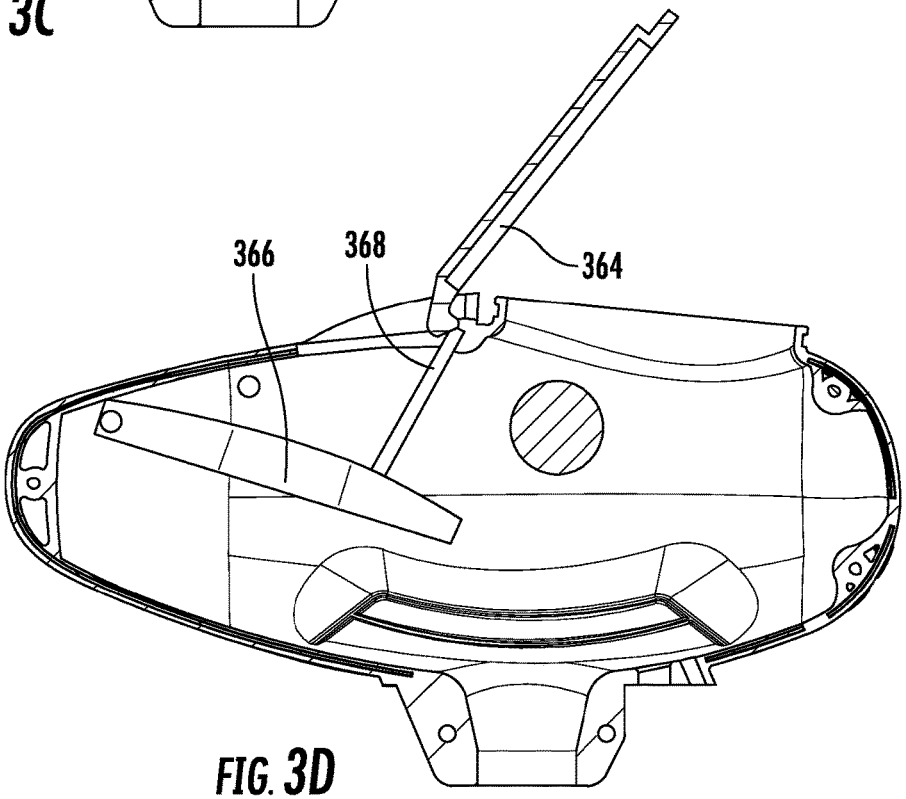
FIG. 3D is an additional side view of the hopper with the lid in an opening position.

As shown in FIGS. 2A and 2B, a fill volume limiting wall 266 can be arranged within a housing 262 of the hopper 260. A linkage can be provided between the wall 266 and the lid 264 such that the wall 266 moves inside an interior chamber of the housing 262 when the lid 264 is opened, decreasing the volume of space within the housing. The wall 266 ensures that the hopper 260 cannot be overfilled or overloaded such that the projectiles 70 become jammed. For example, densely packing foam projectiles into the hopper, such foam projectiles being pliable, could cause lack of movement and a jam. Decreasing the available volume for filling the housing prevents such overfilling. In this manner, interior chamber of the housing has a first volume, and a decreased second volume as set by the fill volume limiting wall 266 when the lid is opened and the fill volume limiting wall 266 is moved to its decreased volume position.

FIGS. 3A-3D illustrate another embodiment of a fill volume limiting wall 366 which is also connected to a lid 364. As shown in FIGS. 3A-3D, a linkage 368 is provided between the lid 364 and the wall 366. The linkage 368 generally translates movement such that when the lid 364 is opened, then the wall 366 moves within the interior of the hopper 360. The wall 366 can generally be positioned in an upper area of an interior of the hopper 360 while the lid 364 is closed, and then is generally shifted downward into a generally middle portion of the hopper 360 as the lid 364 is opened, showing a decreased interior chamber volume for receiving projectiles. One of ordinary skill in the art would understand that the wall 366 can be moved in a variety of ways based on opening of the lid 364. Alternatively, the wall 366 can be moved or adjusted without relying on a position of the lid 364.

FIGS. 2A-3D generally illustrate the concept of linking an external feature of the hopper 260, 360 to an internal feature, such as a volume limiting wall 266, 366, partition, or other type of boundary. As a user engages the external feature of the hopper 260, 360, such as the hopper lid 264, 364, then the internal feature (i.e. wall 266, 366) is moved or displaced. This configuration ensures that the volume of the hopper 260, 360 changes when the lid 264, 364 of the hopper 260, 360 is moved between an opened and closed position and helps prevent overloading of the hopper 260, 360 by changing the volume of the hopper 260, 360 via a partition, boundary, or volume limiting wall 266, 366.

Figure 4:
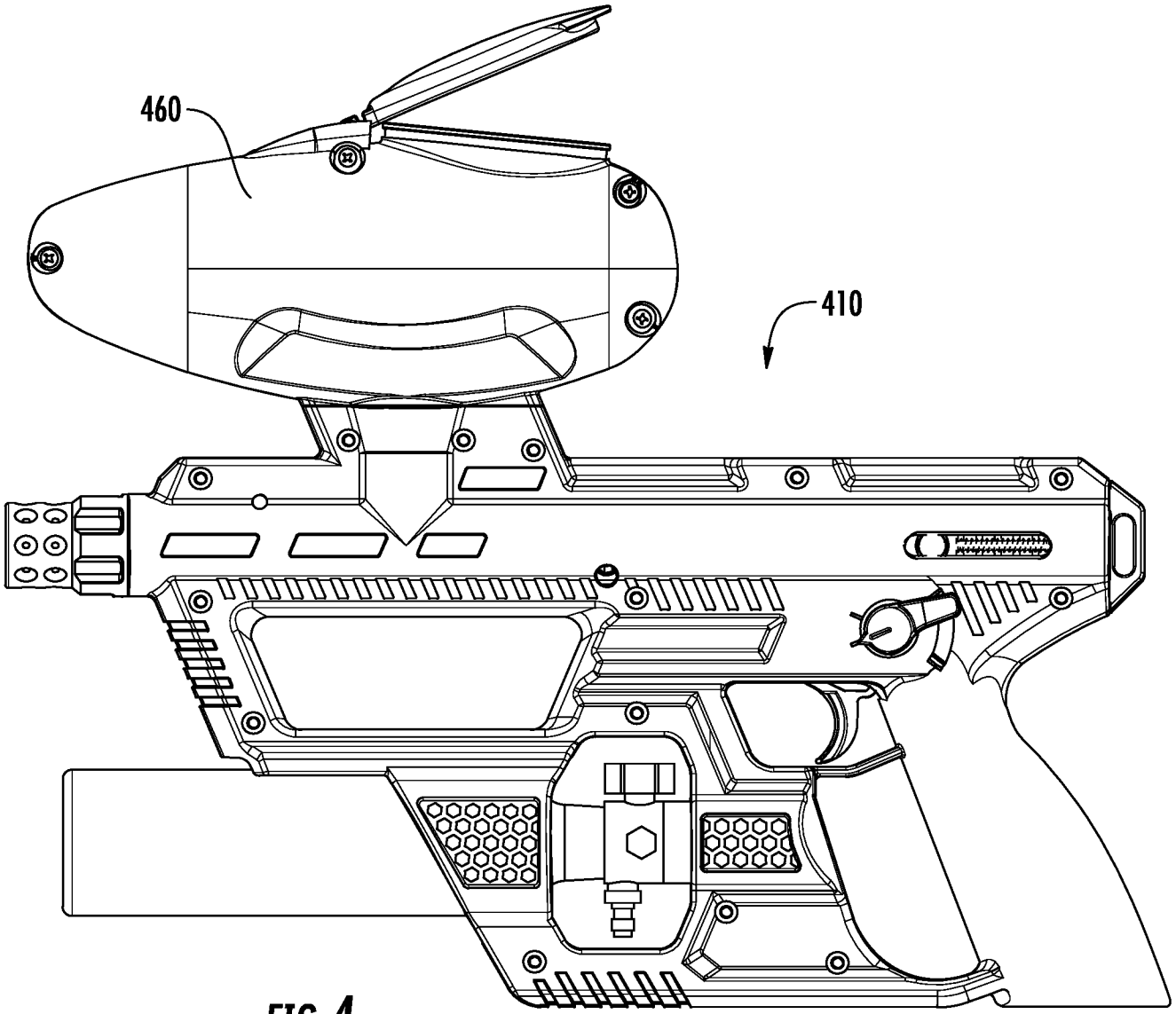
FIG. 4 is a side view of a projectile launching device according to another embodiment.

FIG. 4 illustrates another embodiment of a projectile launching device 410. In FIG. 4, the device includes a hopper 460 having an oval-shaped or egg-shaped profile. All other aspects of the device are otherwise identical to the device 10 of FIGS. 1A and 1B.

Figure 5A:
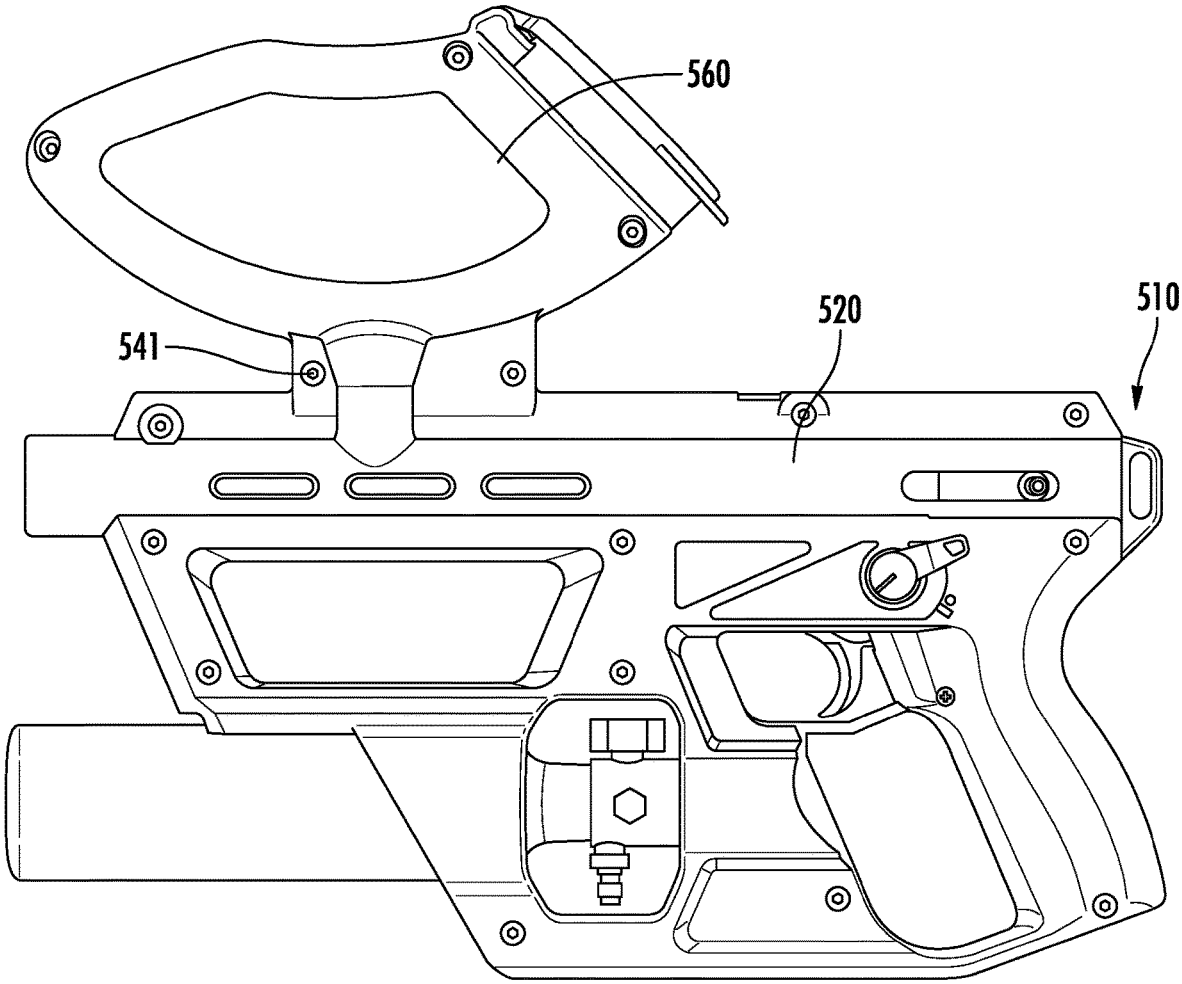
FIG. 5A is a side view of a projectile launching device according to another embodiment.
Figure 5B:
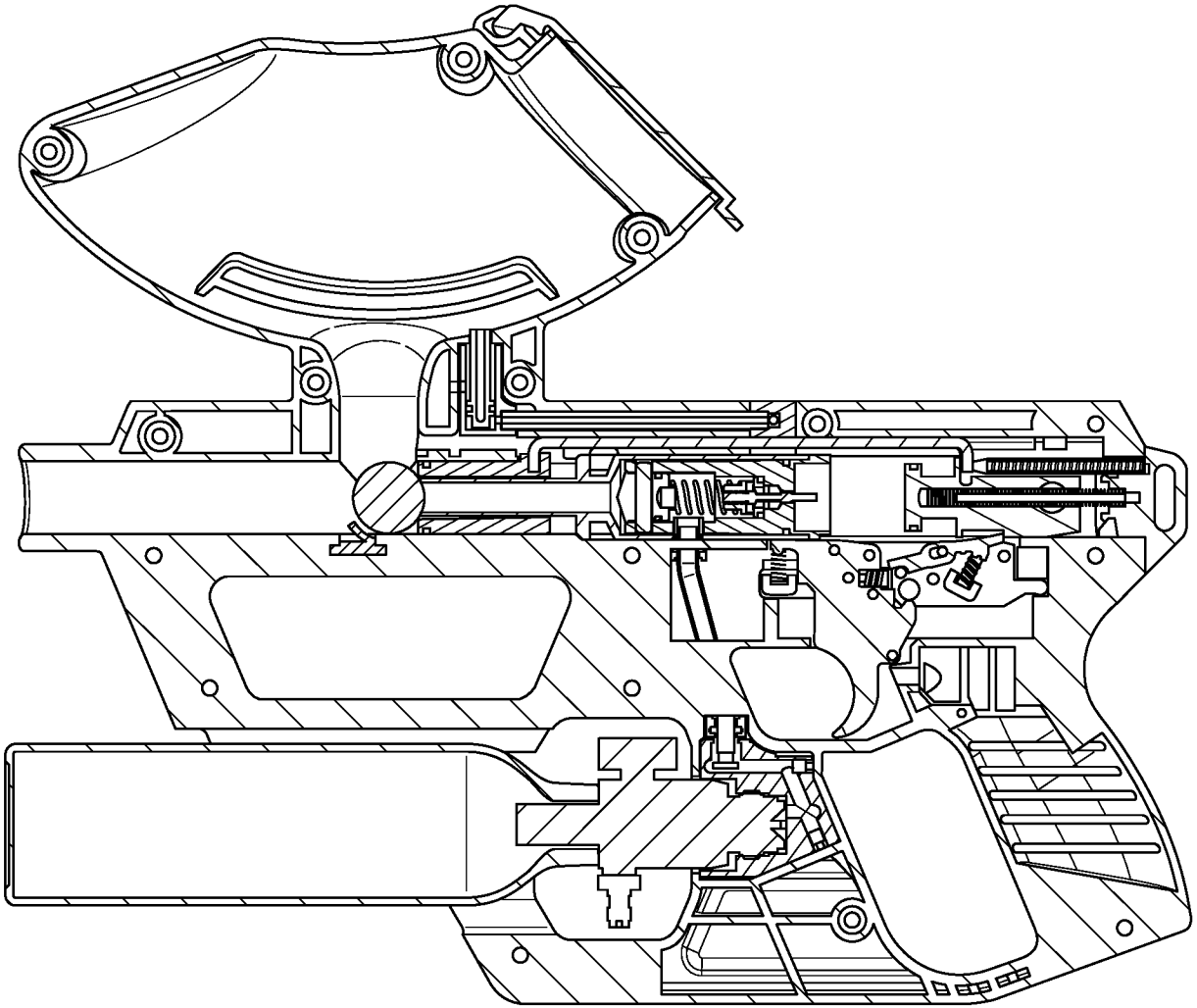
FIG. 5B is a side cross-sectional view of the projectile launching device according to FIG. 5A.
Figure 6A:
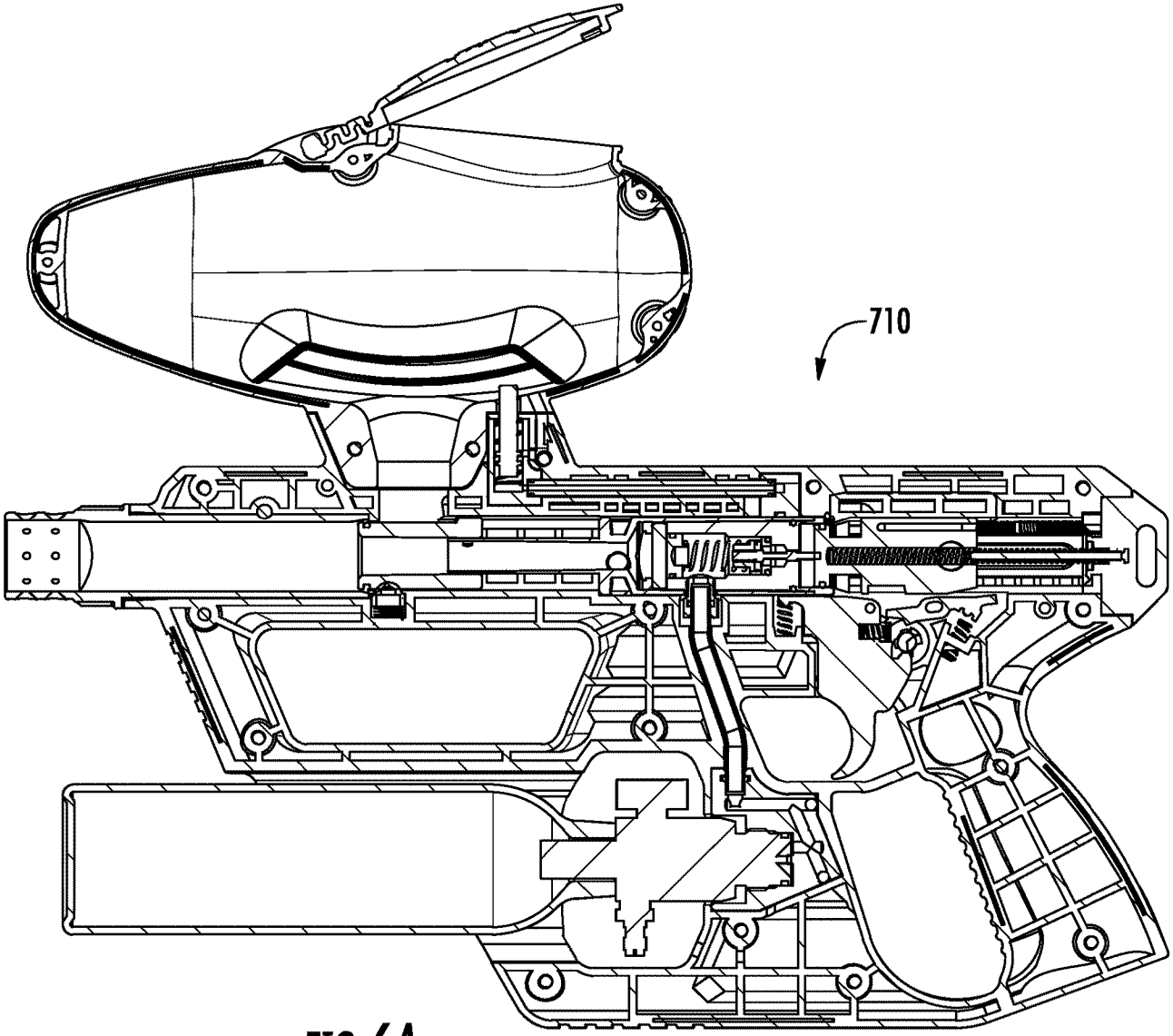
FIG. 6A is a side cross-sectional view of a projectile launching device according to another embodiment.
Figure 6B:
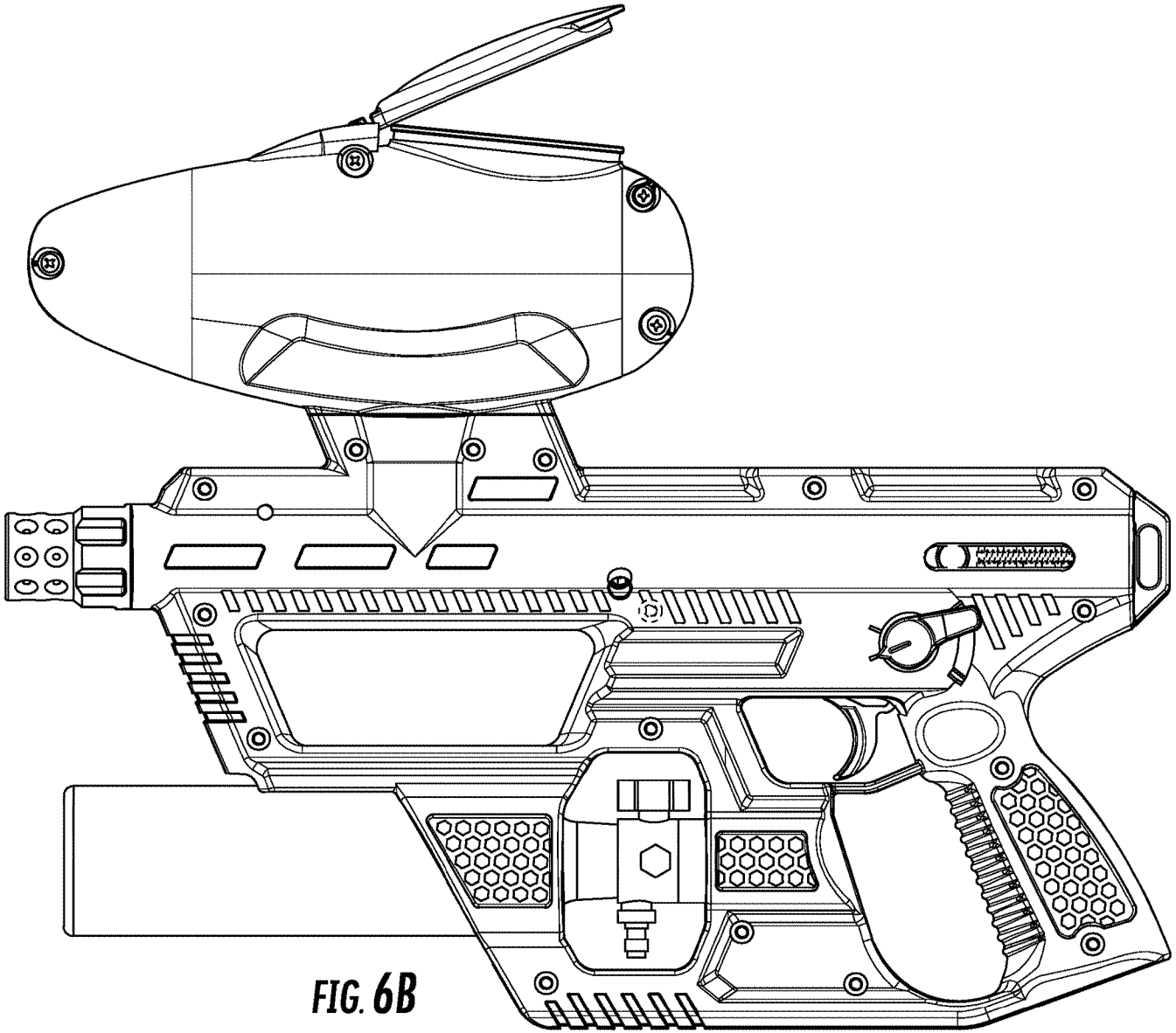
FIG. 6B is a side view of the projectile launching device according to FIG. 6A.
Figure 6C:
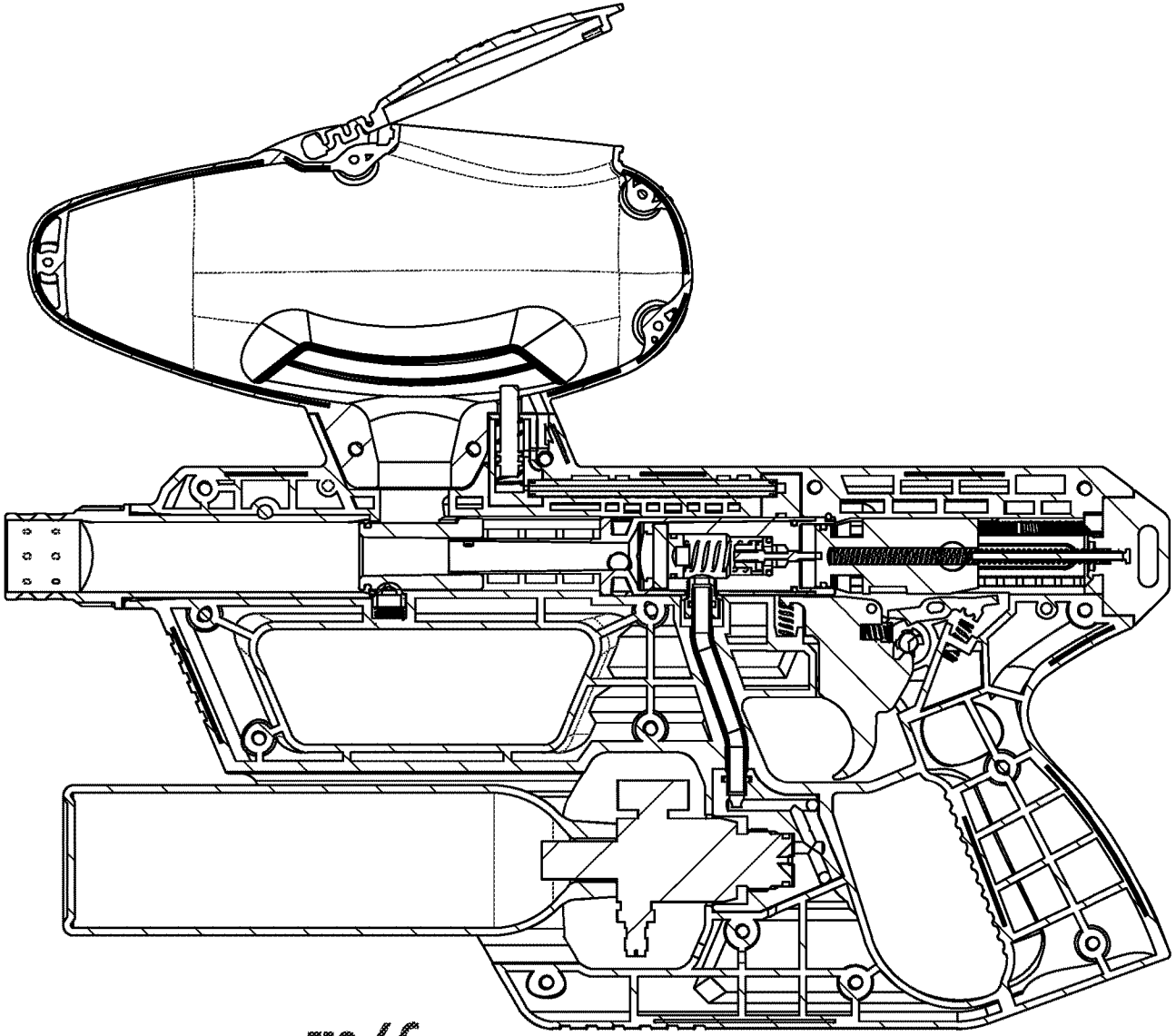
FIG. 6C is a side cross-sectional view of the projectile launching device according to FIGS. 6A-6B.
Figure 6D:
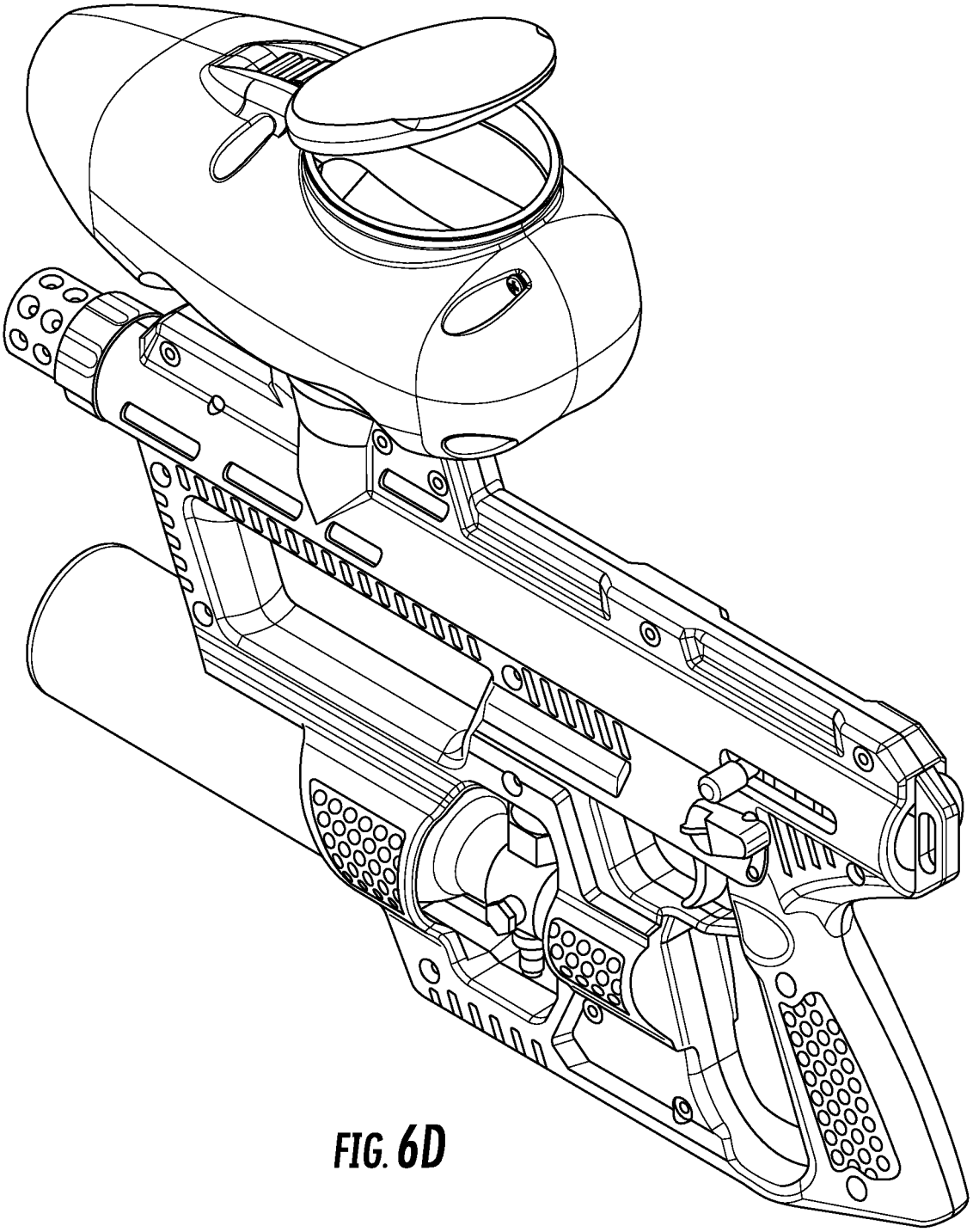
FIG. 6D is a rear top perspective view of the projectile launching device according to FIGS. 6A-6C.

FIGS. 5A and 5B illustrate another embodiment of a projectile launching device 510, which is similar to the embodiment of FIGS. 1A and 1B except a frame 541 extending between the hopper 560 and the body 520 is modified. Specifically, the frame 541 connecting the hopper 560 and the body 520 extends straight upward instead of at an angle.

FIGS. 6A-6D illustrate another embodiment for a projectile launching device 710 that is similar to the embodiment of FIGS. 1A and 1B. The projectile launching device 710 of FIGS. 6A-6D does not include an anti-jam assembly.

Figure 7:
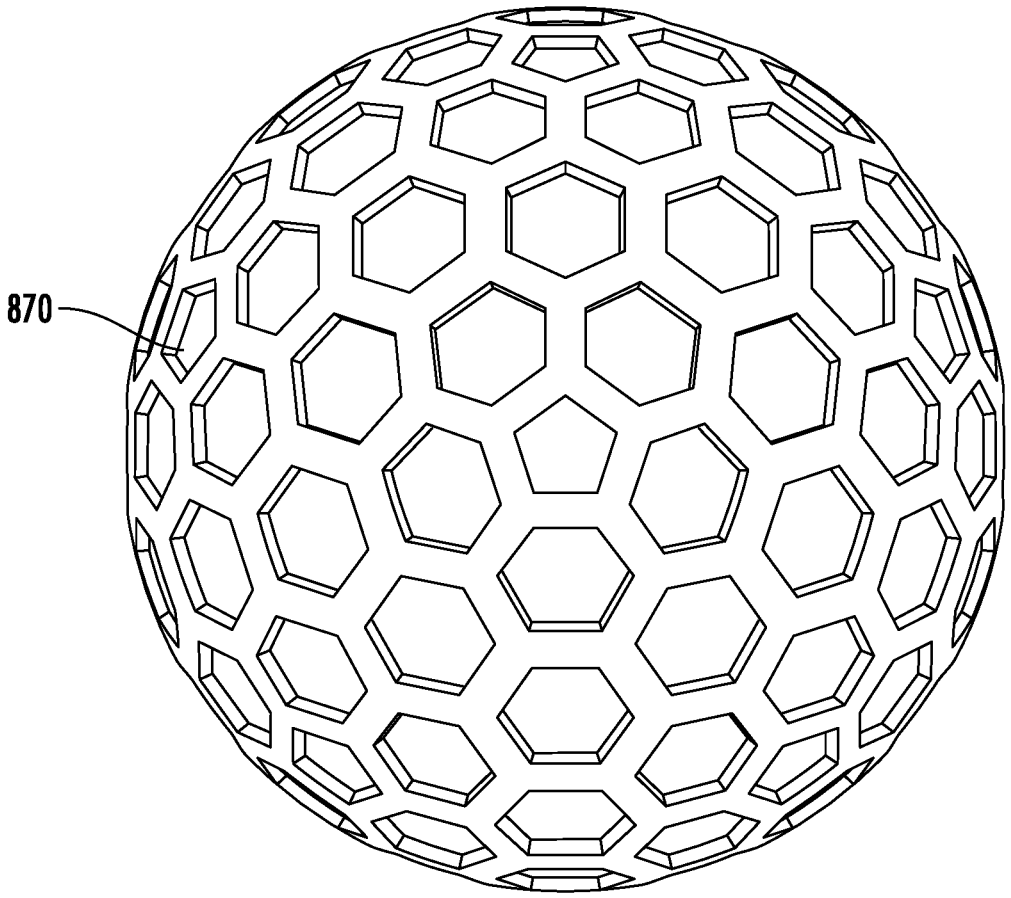
FIG. 7 illustrates a projectile configured to be launched by any of the projectile launching devices illustrated herein.

FIG. 7 illustrates a projectile 870 that is configured to be launched by the projectile launching device 10 or any other projectile launching device from the other figures. In one aspect, the projectile 870 is luminescent or fluorescent. The projectile 870 can include a luminescent or fluorescent coating. Components of the projectile launching devices, such as a loader, feed neck, breech, barrel, hopper or container, etc., can include a black light charger unit which is configured to emit ultraviolet light which is absorbed and re-emitting by the luminescent or fluorescent projectiles.

FIG. 8A-8G illustrate a different embodiment for a projectile launching device 910. In this embodiment, the hopper 960 is a "rear-loading" configuration and includes a loading opening positioned on a rear side of the hopper 960. A lid 916 for the hopper 960 is connected to the rear side of the hopper 960, and the opening of the hopper 960 faces rearwardly when the device is oriented for use. The lid 916 is oriented generally vertically when the device is positioned for use and may be generally perpendicular to a longitudinal axis of the device body. Based on this arrangement, a user can load projectiles into the hopper 960 while the projectile launching device 910 is oriented with its muzzle directed towards the ground. Accordingly, a user can safely load projectiles into the hopper 960 without any risk of inadvertently firing projectiles at oneself or bystanders since the muzzle 929 is directed towards the ground during loading.

Figure 8A:
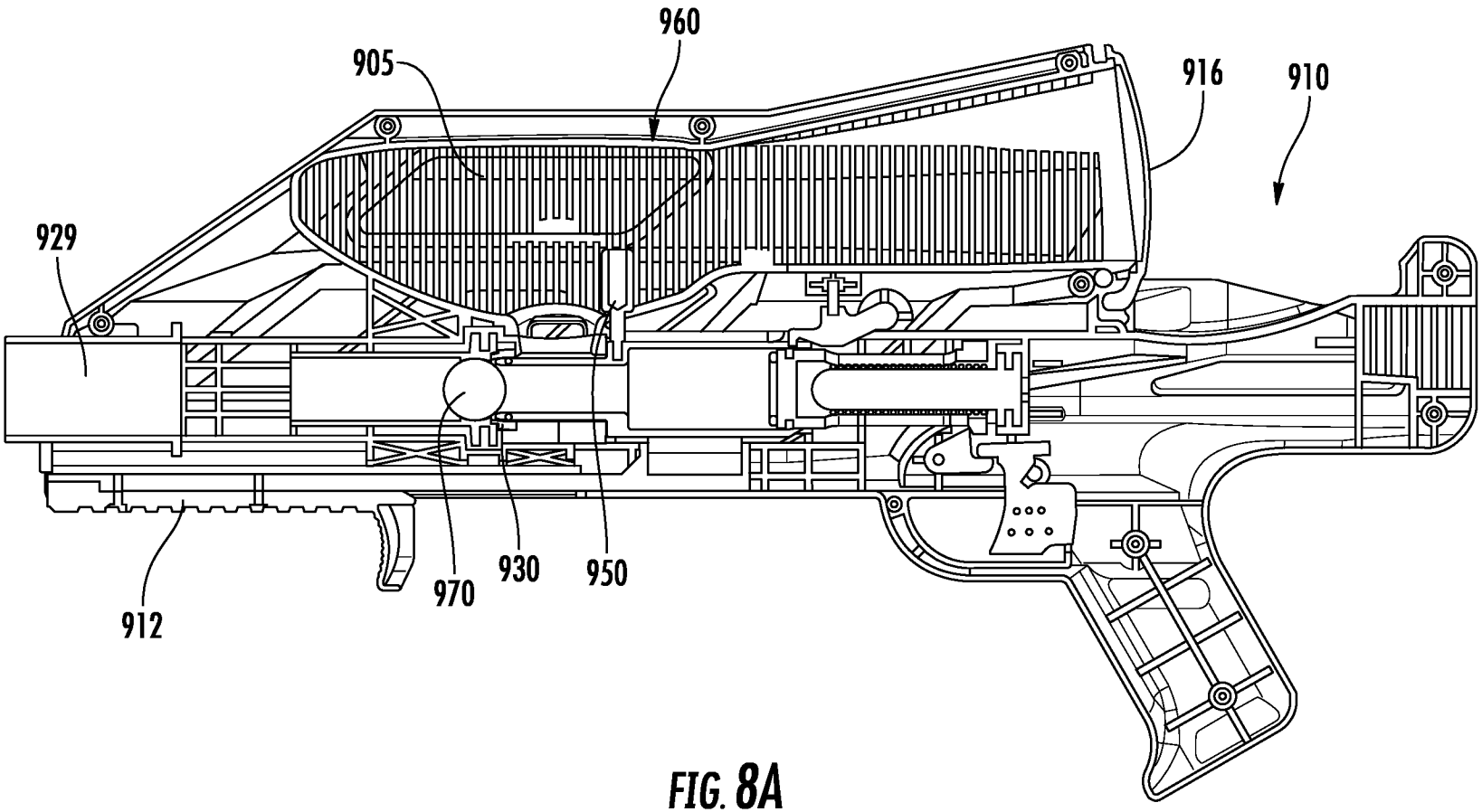
FIG. 8A is a side cross-sectional view of a projectile launching device according to another embodiment.
Figure 8B:
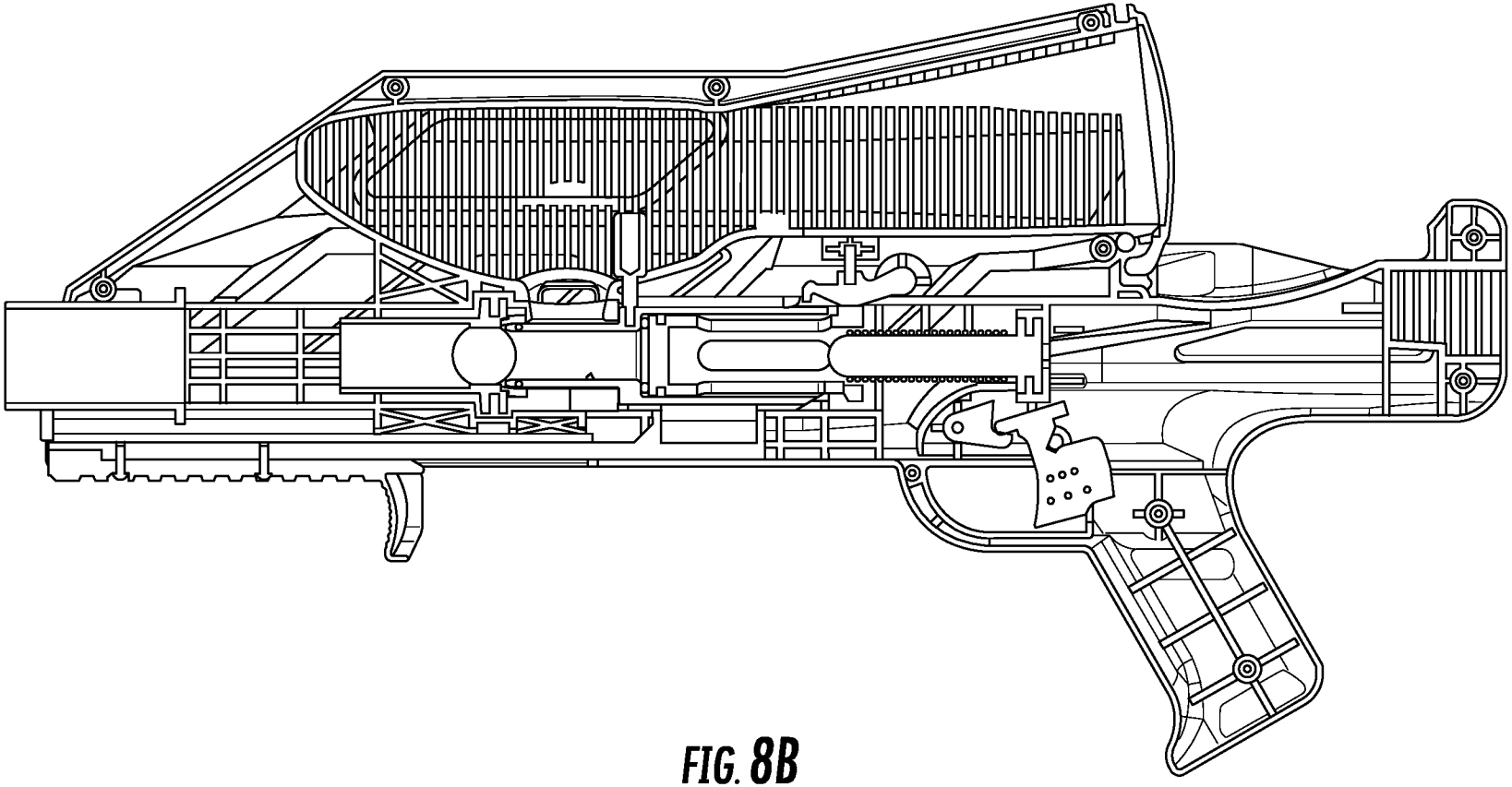
FIG. 8B is a side cross-sectional view of the projectile launching device of FIG. 8A with the triggering mechanism or assembly being engaged.
Figure 8C:
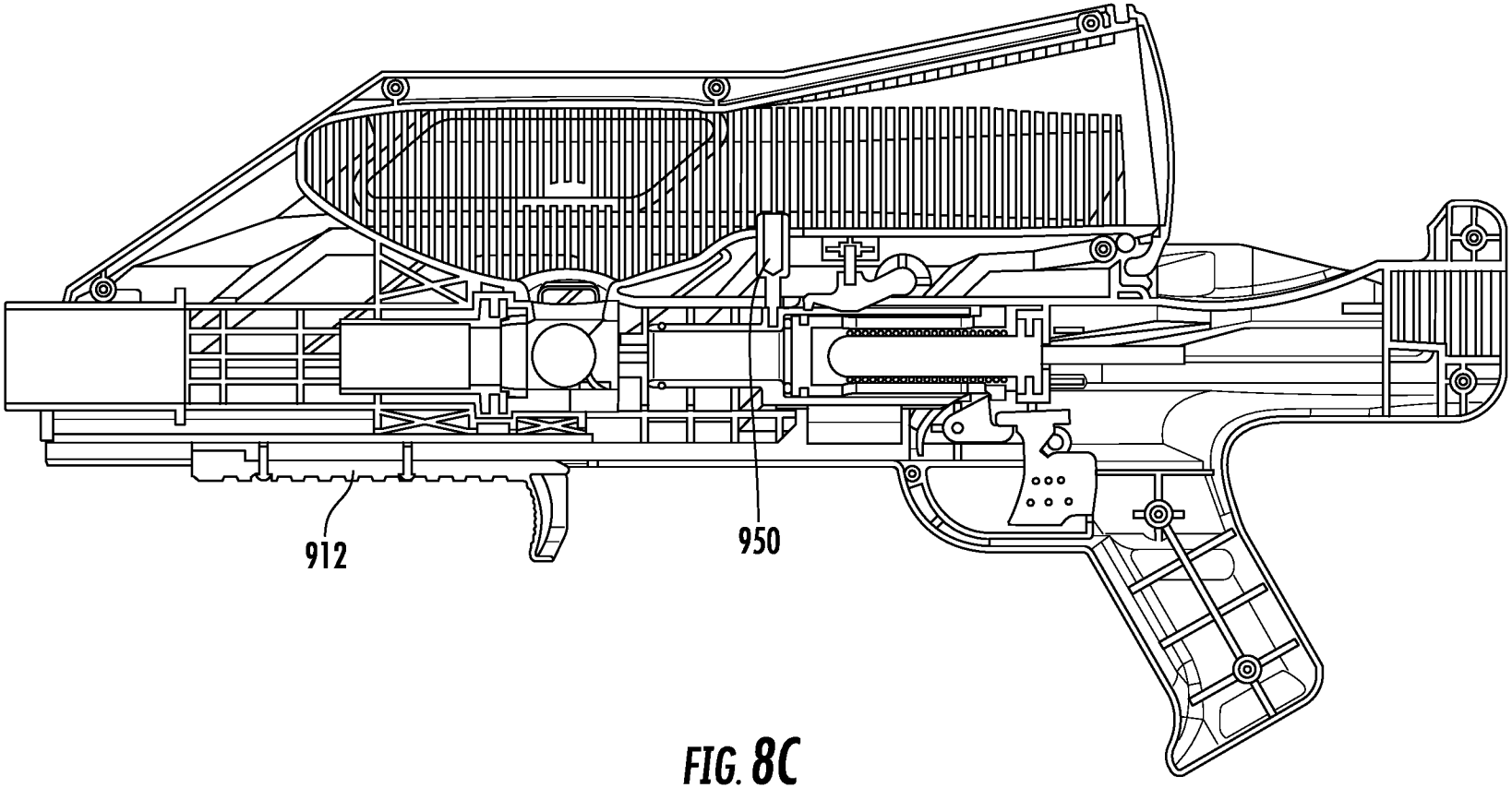
FIG. 8C is a side cross-sectional view of the projectile launching device of FIGS. 8A and 8B in a non-firing state, ready to fire, or rearward state.
Figure 8D:
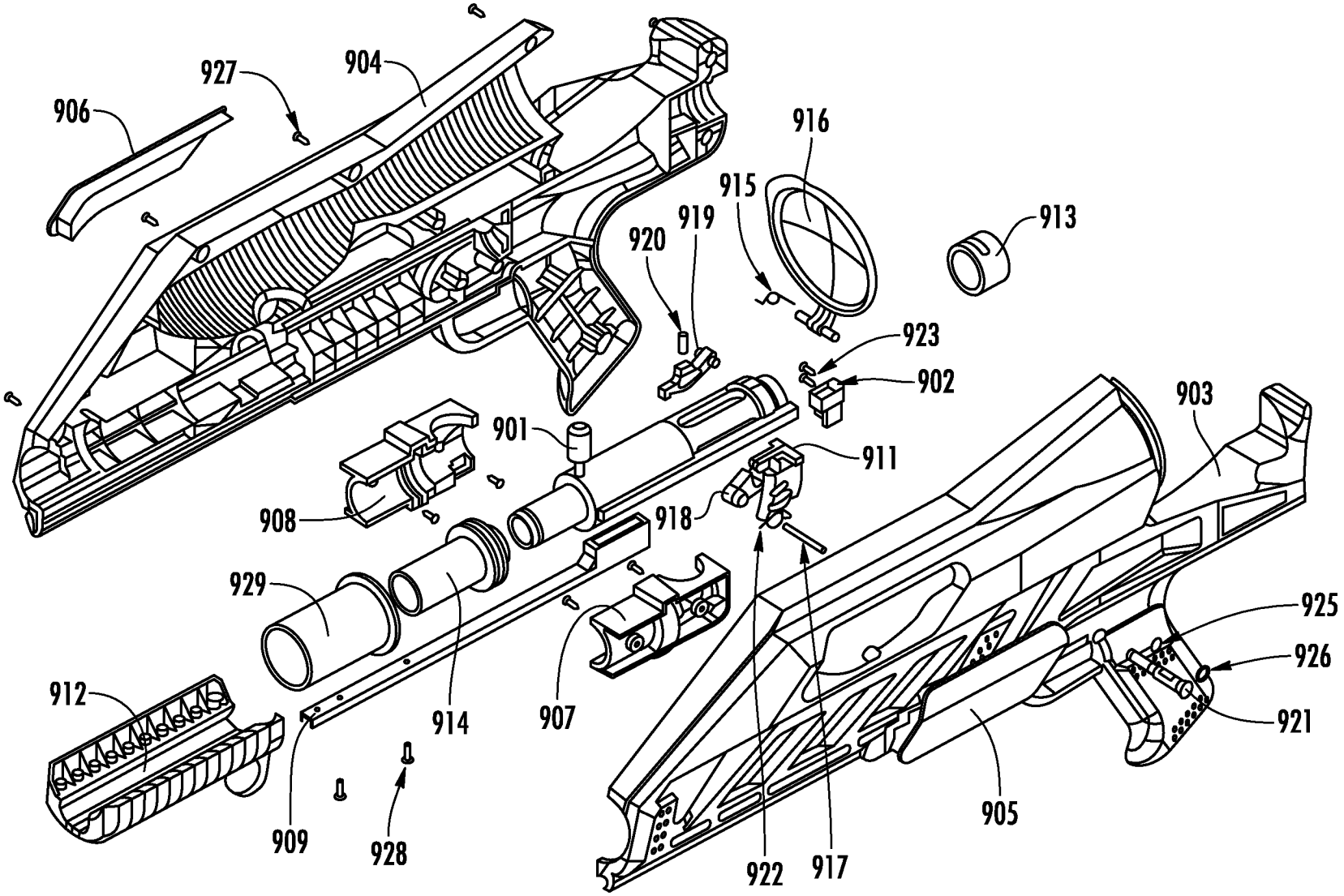
FIG. 8D is an exploded view of the projectile launching device of FIGS. 8A-8C.
Figure 8E:
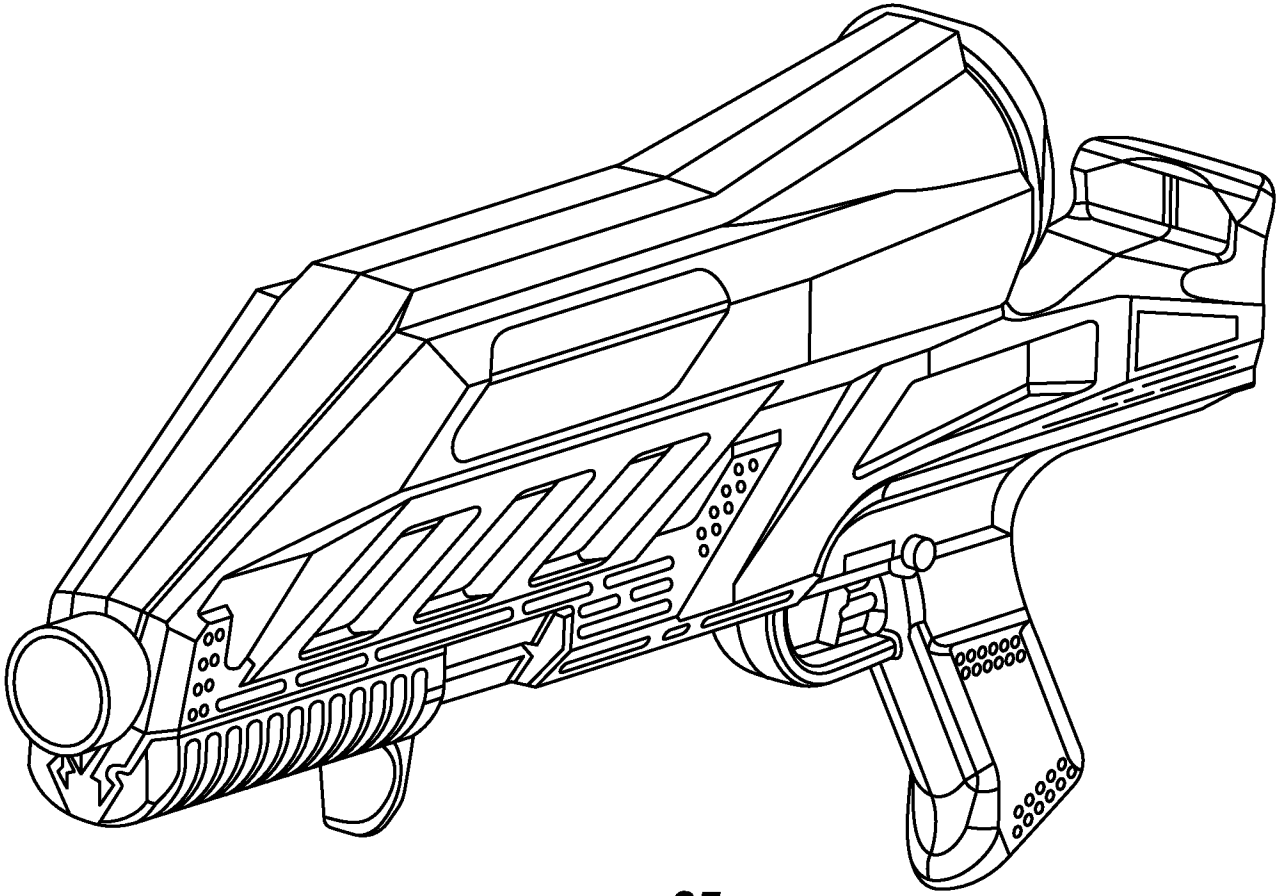
FIG. 8E is a front perspective view of the projectile launching device of FIGS. 8A-8D.
Figure 8F:
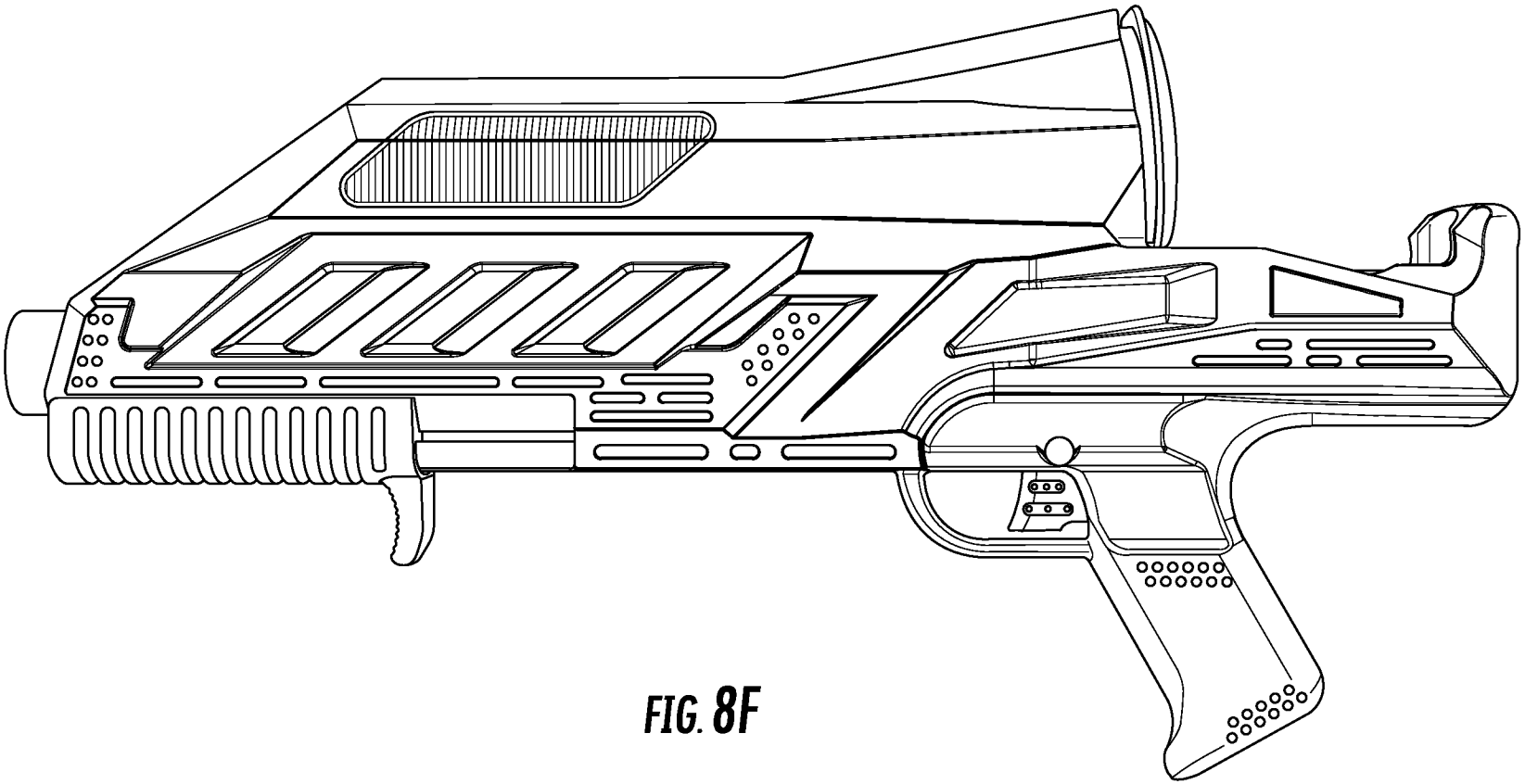
FIG. 8F is a side view of the projectile launching device of FIGS. 8A-8E.
Figure 8G:
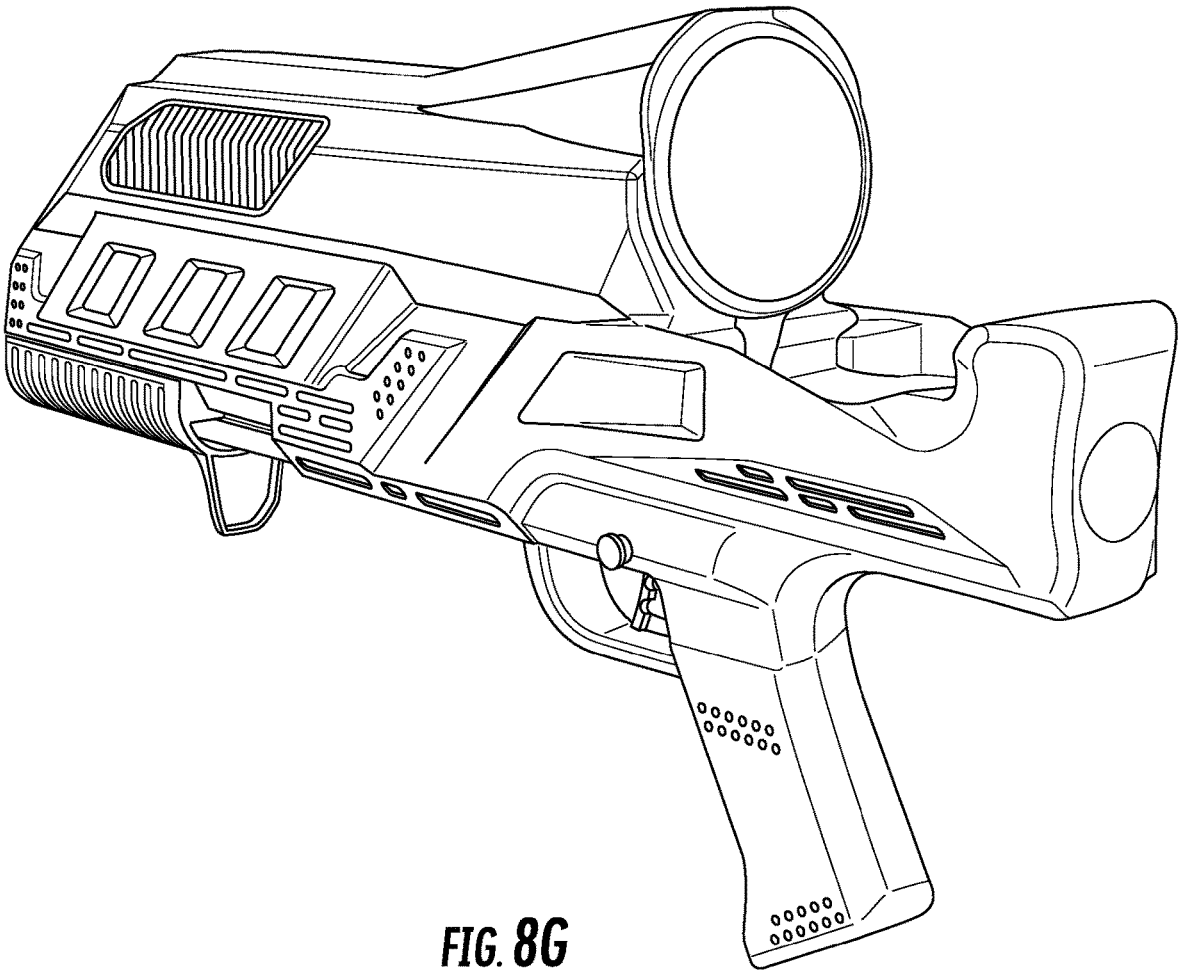
FIG. 8G is a rear perspective view of the projectile launching device of FIGS. 8A-8F.

FIG. 8D illustrates additional elements for the projectile launching device 910. The projectile launching device 910 includes an engine assembly 901, a slide stop assembly 902, a left shell portion 903, a right shell portion 904, a left window panel 905, a right window panel 906, a left body portion 907, a right body portion 908, a rod cocking assembly with inserts 909, a trigger 911, a pump handle 912, a plug stock 913, a barrel with seal overmolded 914, a spring torsion lid 915, the lid with rip clip 916, a dowel pin 917, a sear 918, a lock safety single cocking 919, a spring single cocking safety lock 920, a safety push button 921, a spring sear 922, two O-rings 925, 926, assembly screws 923, 927, 928, and a ball latch or cradle 930. The window panels 905, 906 allow users to visually inspect and determine the quantity of projectiles remaining in the hopper 960.

A projectile agitator 950 extends at least partially inside of the hopper 960 and is configured to move projectiles within the hopper 960. As shown in FIGS. 8A and 8C, as the pump handle 912 is moved forward and backwards, the projectile agitator 950 likewise is moved forward and backwards within an interior area of the hopper 960. One of ordinary skill in the art would understand that the projectile agitator 950 can be linked to various components of the projectile launching device 910, such as the pump handle 912 or other components linked to the pump handle 912. In one aspect, the projectile agitator 950 is configured to be driven forward and backward to agitate projectiles within the hopper 960. The projectile agitator 950 may be shaped with a rounded outer surface so that it will not catch or snap projectiles or rupture projectiles. One of ordinary skill in the art would understand that any other type of motion, such as up and down motion or lateral motion, can be imparted on the projectile agitator 950.

The ball cradle or detent 930 is configured to hold the projectiles 970 after loading and before firing. A user generally drives the pump handle 912 forward and backwards to generate a compressed air that is then used to fire the projectiles 970 down the barrel. Atmospheric air enters the engine assembly 901 when the pump handle 912 is driven backwards. This motion also compresses a spring within the engine assembly 901.

The engine or firing assembly 901 generally includes the following features. A piston within the engine assembly 901 can include an abutment surface or seat configured to engage a compression spring when the piston is driven backwards (i.e. via pumping of the handle 912). The compression spring is then compressed between the piston and an end cap or abutment. Force on the spring is then supplied by the user pulling the pump handle 912, which is connected to an air concentration tube. The air concentration tube is connected to an impact ring, which is inside of the engine assembly 901. The compression spring is compressed and the piston is pulled backwards until a front of a spring seat moves behind the sear 918. The front of the spring seat engages the sear 918 and the compression spring is held in a compressed state until the projectile is fired. The pump handle 912 is then moved forward to load the projectile into the breach and seal off an input port. Atmospheric air pressure then enters the area in front of the piston. When the trigger is engaged, the sear 918 releases the energy of the compression spring, and the piston moves forward past side slots of the air focus tube to seal off a front portion of the air focus tube. Continued forward movement compresses the air and this compressed air travels through the impact ring and the breach to launch the projectile out of the barrel.

Figure 9A:
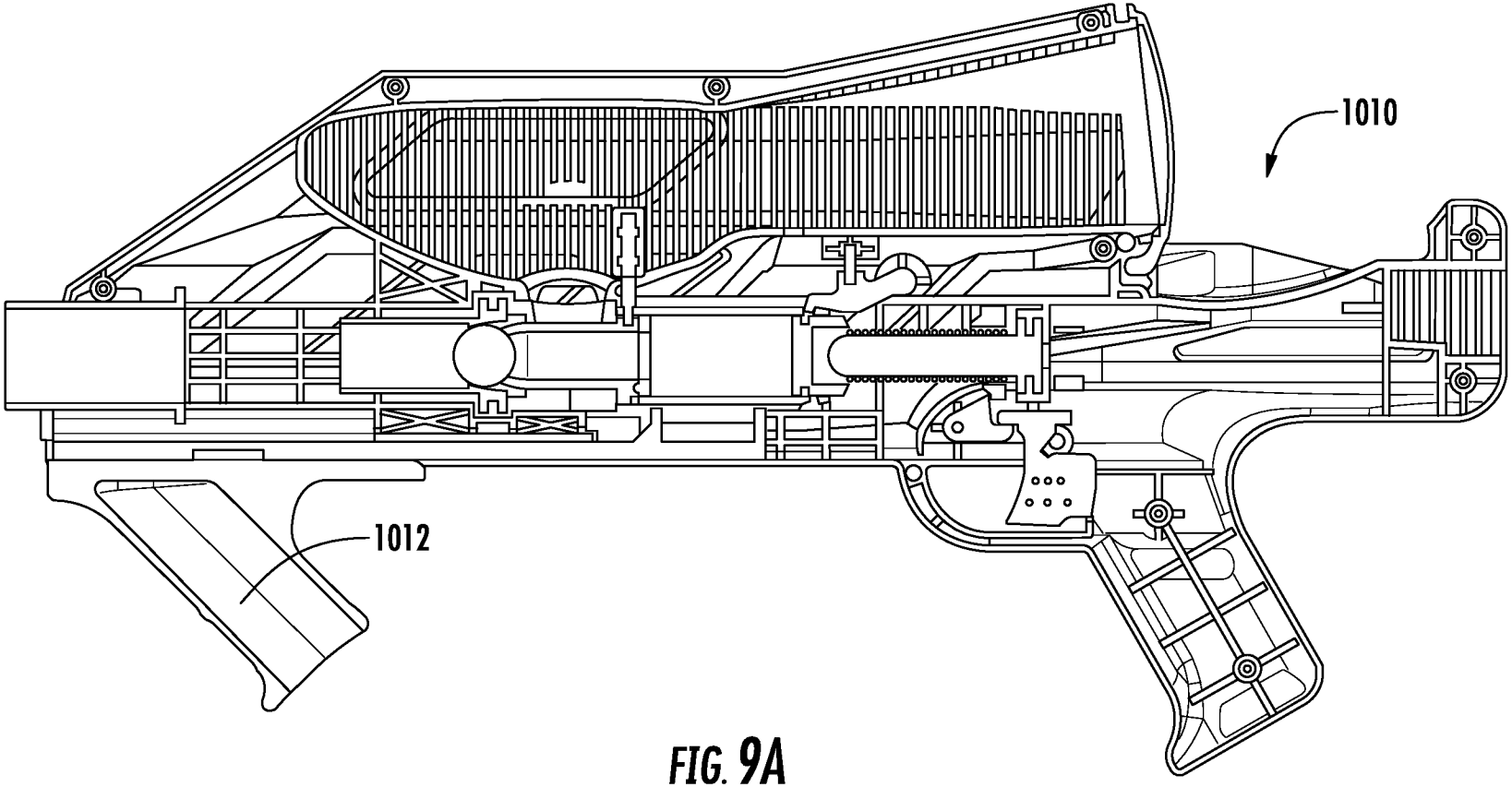
FIG. 9A is a side cross-sectional view of a projectile launching device according to another embodiment.
Figure 9B:
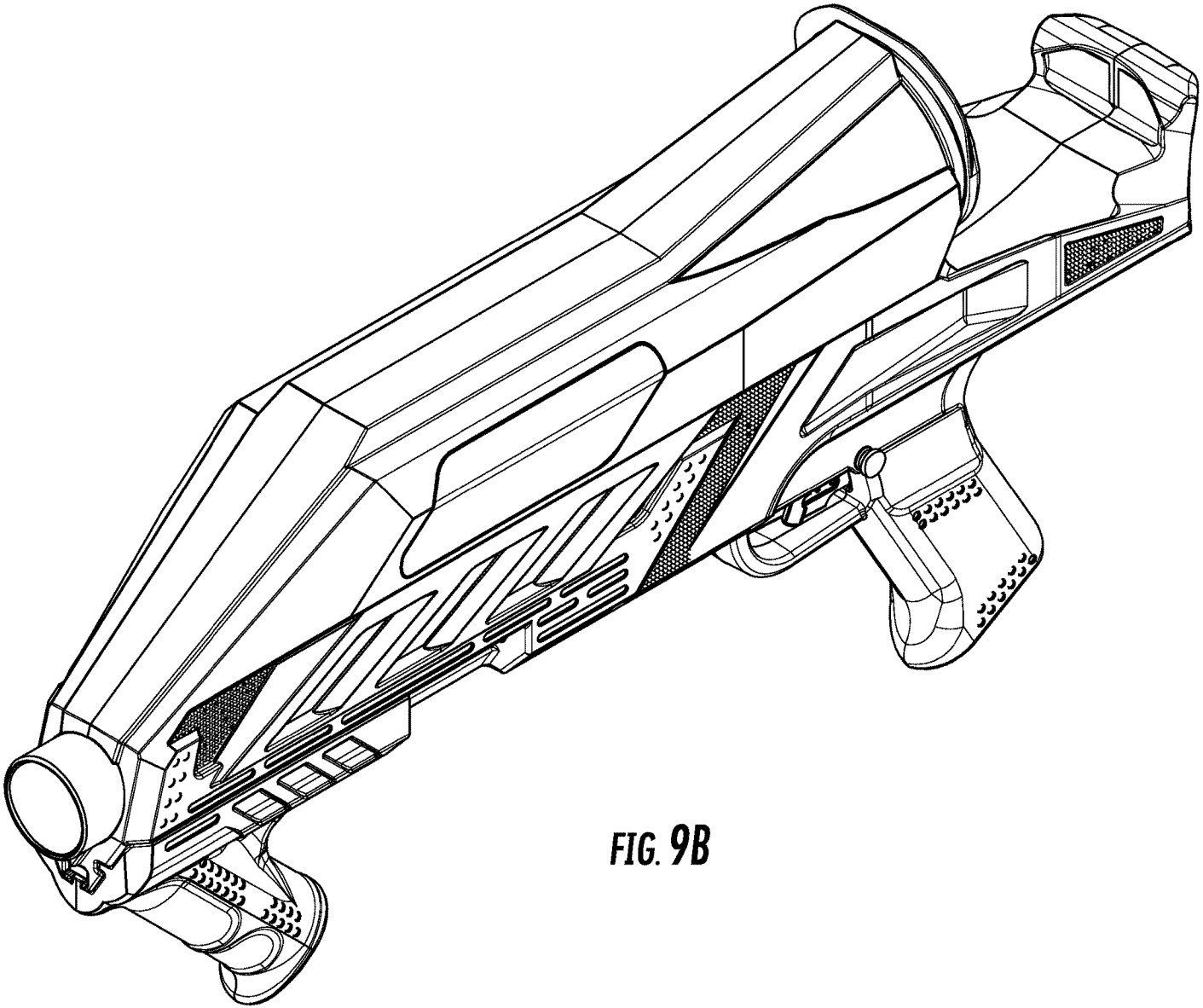
FIG. 9B is a front perspective view of the projectile launching device of FIG. 9A.
Figure 9C:
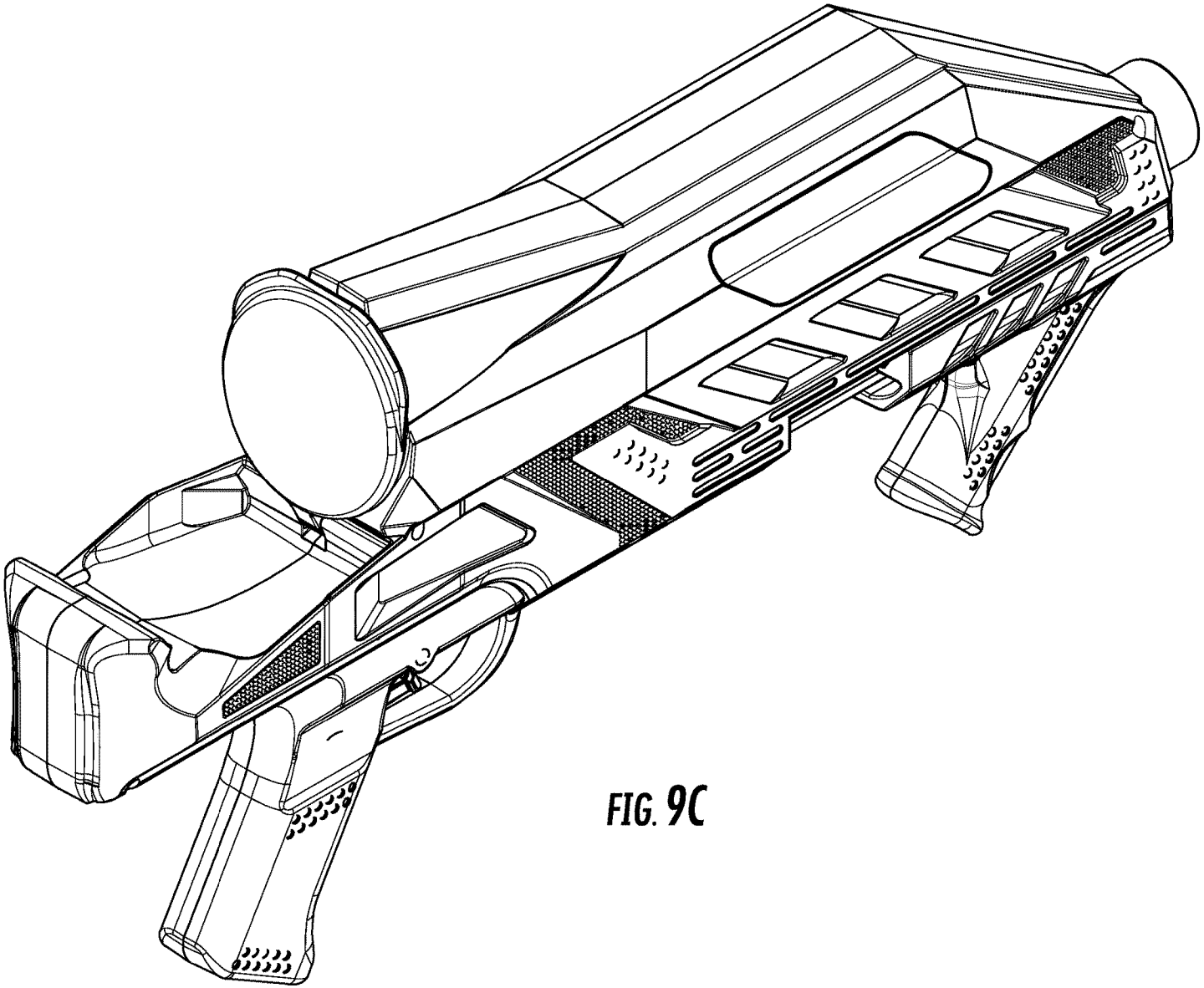
FIG. 9C is a rear perspective view of the projectile launching device of FIGS. 9A-9B.

FIGS. 9A-9C illustrate another embodiment for a projectile launching device 1010 that is substantially similar to the projectile launching device 910, but has a modified pump handle 1012 that is angled away from the barrel assembly.

Figure 10A:
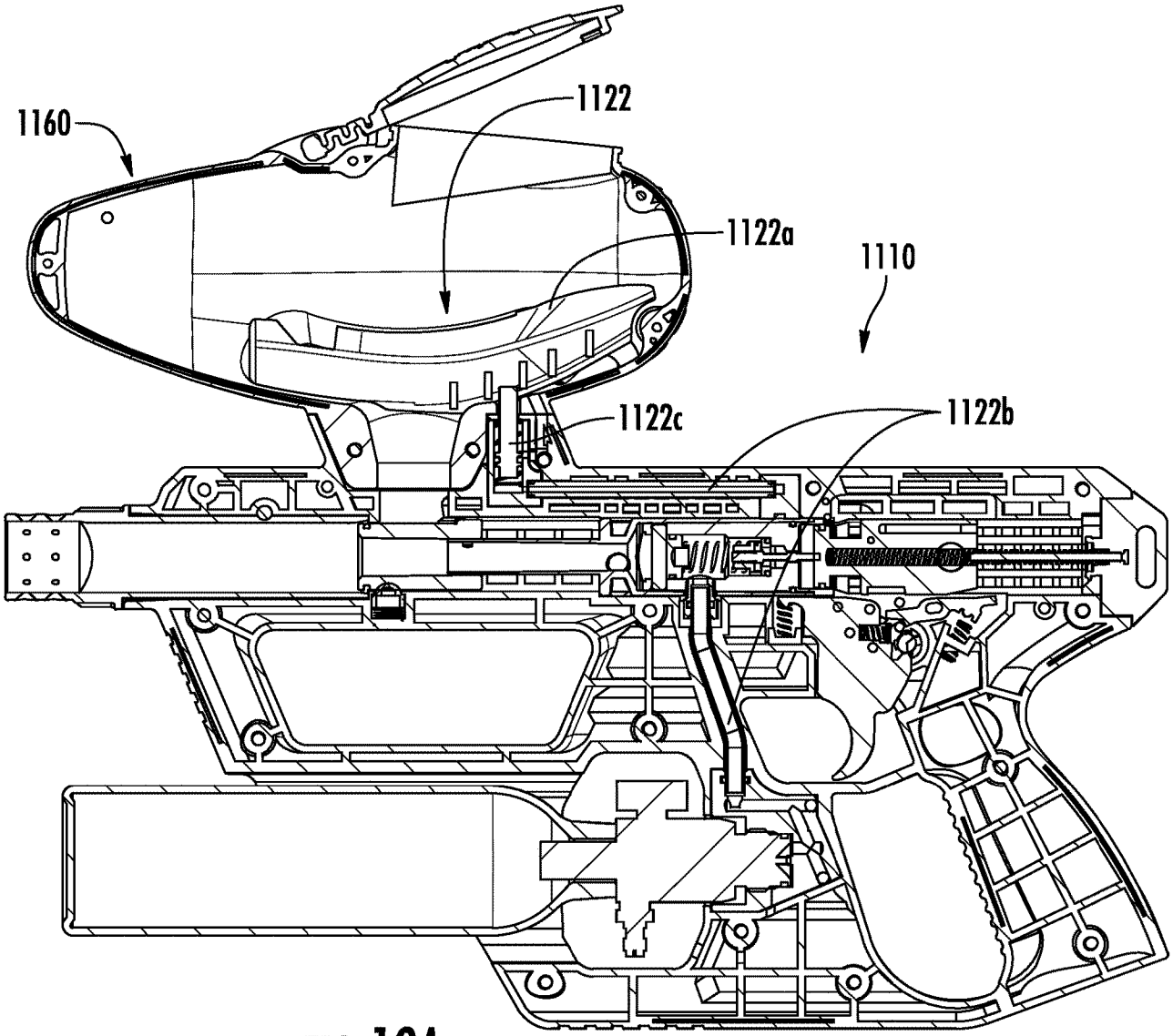
FIG. 10A is a side cross-sectional view of a projectile launching device including an agitator.
Figure 10B:
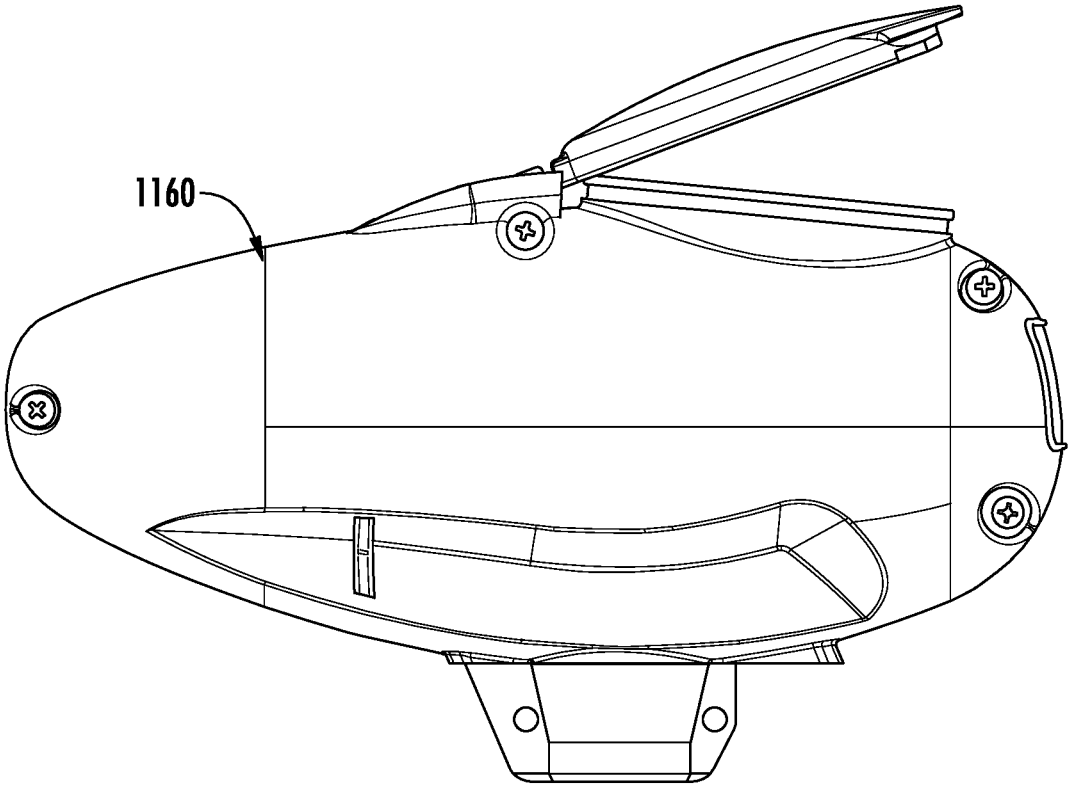
FIG. 10B is a side view of a hopper of the device of FIG. 10A.

As shown in FIGS. 10A-10E, a projectile launching device 1110 is disclosed that includes an agitator assembly 1122, which may be provided generally as a moving surface or floor. In one aspect, the agitator assembly 1122 is arranged in the interior area of the hopper 1160. The agitator assembly 1122 can generally include an agitating surface 1122*a*. In one aspect, the agitating surface 1122*a* partially forms a movable or displaceable floor panel of the hopper 1160. One of ordinary skill in the art would understand that the agitating surface 1122*a* could be provided in any location of the hopper 1160. The agitating surface 1122*a* is configured to be agitated or move relative to an inner chamber or interior area defined by the hopper 1160. Movement of the agitating surface 1122*a* ensures that projectiles within the hopper 1160 do not jam or are not bunched together with each other. Various driving means can be provided to move the agitating surface 1122*a*. As shown in FIG. 10A, a compressed air supply line 1122*b*, having an upper and lower portion, can be provided to selectively provide pressurized or compressed air to move the agitating surface 1122*a*, such as each time the poppet valve is actuated. The air supply line 1122*b* is configured to be supplied by the same compressed gas cannister that generally provides the projectile firing power for the device 1110.

In one aspect, a piston 1122*c* is in fluid connection with the compressed gas supplied to the compressed air supply line 1122*b* and is configured to abut the agitating surface 1122*a* and drive the agitating surface 1122*a*, such as in an upward direction. In one aspect, each time that the trigger is pulled or actuated, and the poppet valve associated with the piston 1122*c* is actuated, a portion of the compressed gas can be supplied or bled to the upper portion of the compressed air supply line 1122*b*, which actuates the piston 1122*c* and drives the agitating surface 1122*a* such as in an upward motion.

Figure 10C:
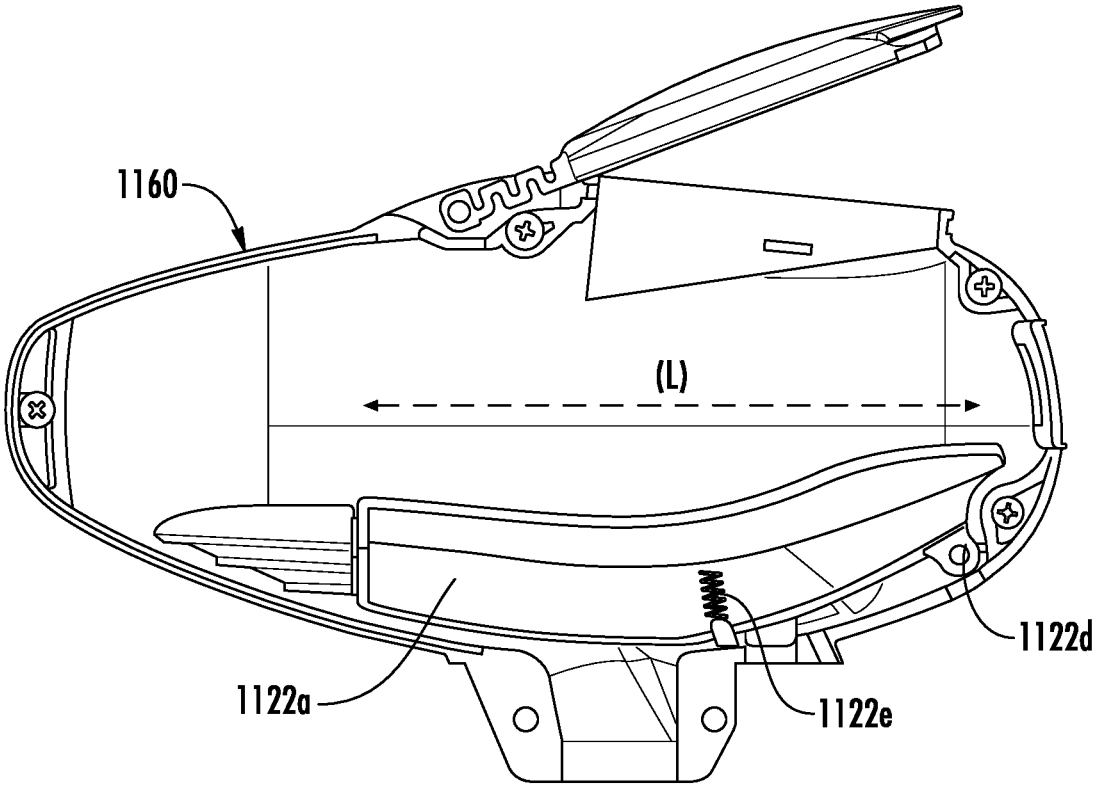
FIG. 10C is a side cross-sectional view of the hopper of FIGS. 10A and 10B.

The agitating surface 1122*a* can be driven in a linear manner or in a rotational or pivoting manner, depending on how the agitating surface 1122*a* is connected to the hopper 1160. As shown in FIG. 10C, a pivot connection 1122*d* or hinge can connect the agitating surface 1122*a* to the hopper 1160. A return spring 1122*e* can also be provided to bias the agitating surface 1122*a* to a lower or non-actuated position. The piston 1122*c* acts in an opposite direction from the return spring 1122*e*. During operation, the piston 1122*c* is driven upward when compressed air is fed to it, and then the return spring 1122*e* quickly pulls the agitating surface 1122*a* back downwards when compressed air is no longer fed to the piston 1122*c*.

Figure 10D:
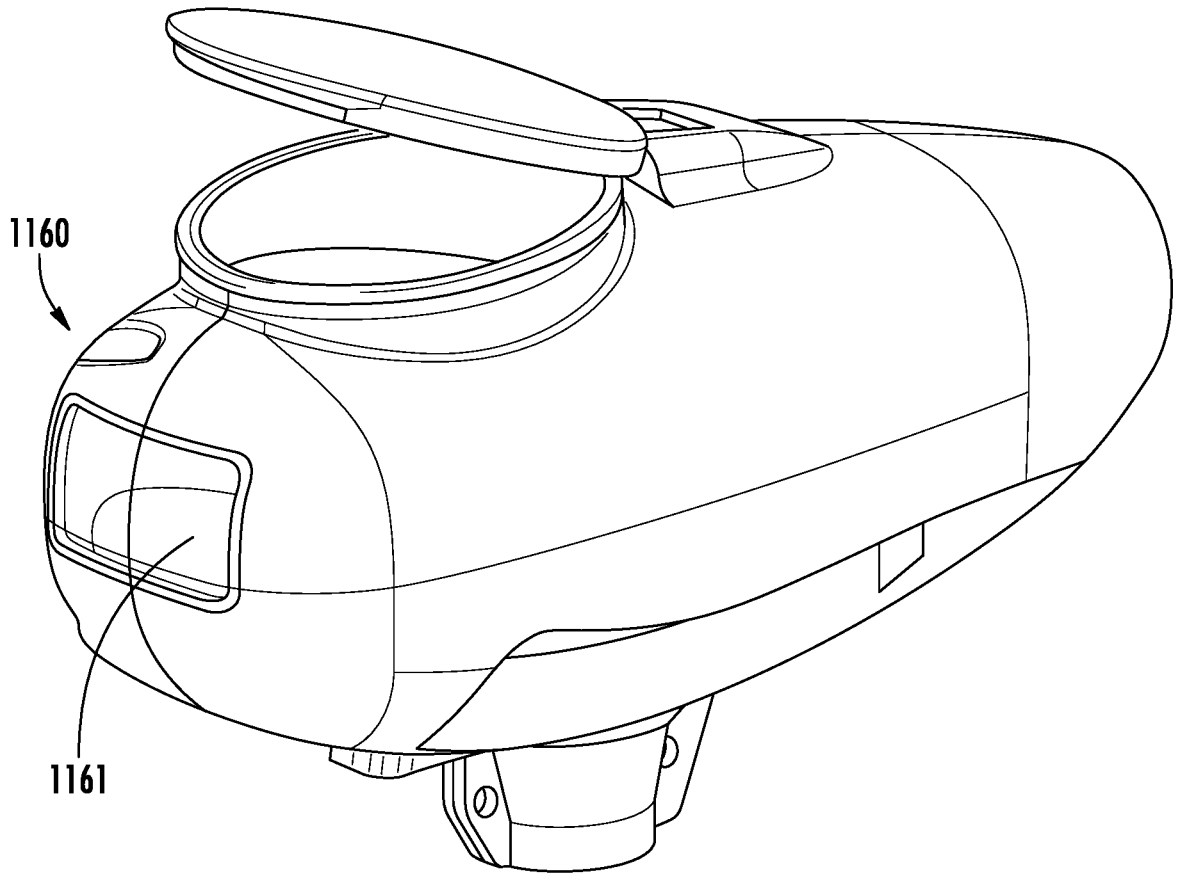
FIG. 10D is a rear perspective view of the hopper of FIGS. 10A-10C.
Figure 10E:
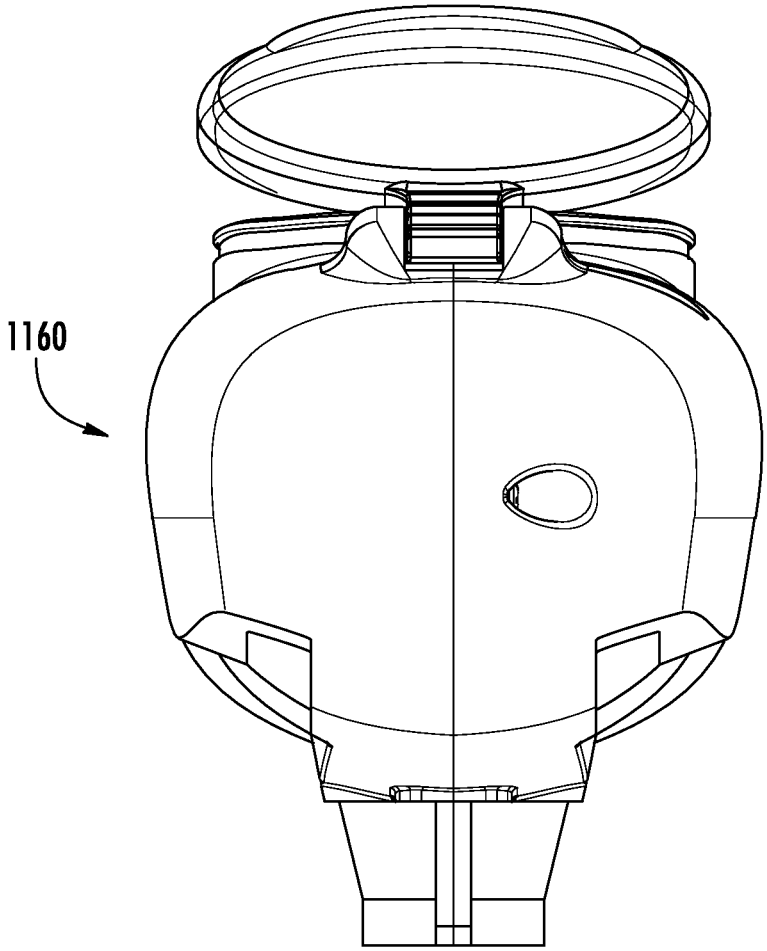
FIG. 10E is a front view of the hopper of FIGS. 10A-10D.

As shown in FIG. 10C, the agitating surface 1122*a* can have a length (L) that is at least half of a total length of the hopper 1160. This relatively large surface area of the agitating surface 1122*a* provides a reliable way to dislodge projectiles. Preferably, the agitating surface 1122*a* does not cover the opening at the bottom of the hopper, or selectively partially covers a portion of the opening. As shown in FIG. 10D, the rear face of the hopper can include a window 1161 so that the contents are visible to a user, and the level of projectiles in the hopper can be monitored.

In one aspect, the supply of compressed gas to operate the projectile agitator assembly 1122, such as the piston 1122*c*, may be supplied from different ports, and may be supplied directly from a valve, an exhaust port, or upstream or downstream (following the flow of compressed gas from a rearward portion of the body to a forward portion of the body) from a valve (i.e. the valve assembly). In one aspect, the gas supplied to the projectile agitator assembly 1122 is fed as exhaust or firing gas relative to the gas supplied for firing the projectiles. In a preferred embodiment, upon actuation of the valve, such as by the hammer hitting the valve stem, the released firing gas is channeled through a channel, passage or port to actuate the agitator assembly 1122. In this manner, the gas used to actuate the agitator assembly 1122 may be considered upstream from the bolt and firing tube. One or more passages or channels can be supplied or positioned adjacent the valve assembly, such that, upon actuation of the valve assembly, gas used to actuate the agitator assembly 1122 is channeled through a passage upstream of the bolt and firing tube. It is appreciated that those of skill in the art can adjust the placement or location of the passages used to feed gas to the agitator assembly 1122.

FIGS. 11A and 11B illustrate another aspect of a projectile launching device. As shown in FIGS. 11A and 11B, the frame 48 of the projectile launching device includes an opening 29 dimensioned to receive the cannister or tank 50 of compressed air. A locking assembly 51 is provided on the frame 48 for further securing the tank 50. The locking assembly 51 may be configured to engage a medial region of the tank 50, in one aspect, but it is appreciated that the locking assembly 51 can be positioned to engage the tank 50 at other locations. The locking assembly 51 is generally configured to prevent unintentional rotation of the tank 50 when the tank 50 is screwed onto the projectile launching device at a tank interface or gas coupling 48*a* (which provides the compressed air to the firing mechanism and the agitating assembly). In this manner, when a user grips the tank as, for example, a foregrip during use, the tank will not rotate and disengage from the tank interface or gas coupling 48*a*, thus causing the projectile launching device not to fire. The locking assembly 51 can include a clamping ring in one aspect. In another aspect, the locking assembly 51 can have a clam shell type locking interface with the tank 50. The locking assembly 51 can include a locking ring 51*a* and a securing element 51*b* configured to attach the locking assembly 51 to the frame 48. The locking ring 51*a* is configured to engage around a circumference of tanks of varying sizes and can be adjusted via a user based on a size of the tanks. In one aspect, the locking assembly 51 can be partially concealed within the opening 49 of the frame 48.

Having thus described the present disclosure in detail, it is to be appreciated and will be apparent to those skilled in the art that many physical changes, only a few of which are exemplified in the detailed description of the invention, could be made without altering the inventive concepts and principles embodied therein.

It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the embodiments being indicated by the appended claims rather than by the foregoing description, and all alternate embodiments and changes to this embodiment which come within the meaning and range of equivalency of said claims are therefore to be embraced therein.

What is claimed is:

1. A projectile launching device comprising:

a hopper configured to retain projectiles;

a body including a projectile agitator assembly comprising a piston configured to selectively move within an interior of the hopper;

the projectile agitator assembly comprising an agitating panel separate from and unattached to the piston and configured to be moveable in response to a selective movement of the piston with respect to the agitating panel, the agitating panel comprising a generally concave upper surface curving away from an upper wall of the body and having a medial portion that extends toward an outlet opening of the body;

a grip assembly including a handle and a trigger assembly arranged below a rear portion of the body; and a frame positioned below a barrel of the projectile launching device, the frame comprising an opening dimensioned to receive and support a compressed gas canister by surrounding a part of a compressed gas cannister other than a threaded portion of the compressed gas cannister such that at least a portion of the compressed gas canister is positioned below the barrel.

2. The projectile launching device according to claim 1, wherein the piston is gas actuated.

3. The projectile launching device according to claim 1, wherein the body includes an anti-jam assembly.

4. The projectile launching device according to claim 3, wherein the anti-jam assembly includes a linkage and an anti-jam spring.

5. The projectile launching device according to claim 1, wherein the frame comprises a sleeve defining the opening dimensioned to receive and support the compressed gas canister.

6. The projectile launching device according to claim 5, wherein the opening has a longitudinal axis (X1) extending parallel to a longitudinal axis (X2) of the body.

7. The projectile launching device according to claim 5, wherein the opening of the frame is positioned below the hopper.

8. The projectile launching device according to claim 1, wherein at least a portion of the frame is positioned below the trigger assembly.

9. The projectile launching device according to claim 1, wherein the frame is positioned longitudinally inward from a projectile launching opening defined on the body.

10. The projectile launching device according to claim 1, wherein the hopper includes a housing defining an interior chamber configured to retain the projectiles, a lid attached to the housing, and a fill volume limiting wall arranged within the housing that blocks a portion of the interior chamber.

11. The projectile launching device according to claim 1, further comprising luminescent projectiles that are configured to be launched by the projectile launching device.

12. The projectile launching device according to claim 1, wherein the agitating panel has at least one raised end as compared to the medial portion.

13. The projectile launching device according to claim 12, wherein a compressed gas configured for a firing operation of the launching device is diverted to operate the piston.

14. The projectile launching device according to claim 13, wherein a compressed air supply line is in communication with the piston, and the compressed air supply line is configured to provide a predetermined amount of a compressed air to the piston each time a trigger of the trigger assembly is actuated.

15. The projectile launching device according to claim 12, wherein the agitating panel is connected to an interior wall of the hopper via a pivot connection, and a return spring is provided to bias the agitating panel to a non-actuated position.

16. The projectile launching device according to claim 12, wherein the agitating panel has a length (L) that is at least half of a total length of the hopper.

17. The projectile launching device according to claim 1, wherein the hopper further comprises a fill volume limiting wall arranged within an interior of the hopper and connected to a lid, wherein a linkage is provided between the lid and the fill volume limiting wall such that the fill volume limiting wall is displaced when the lid is opened.

18. The projectile launching device according to claim 1, wherein at least portion of a housing of the hopper is transparent such that an interior chamber of the hopper is visible.

* * * * *